US006703912B2

(12) United States Patent
Suma et al.

(10) Patent No.: US 6,703,912 B2
(45) Date of Patent: Mar. 9, 2004

(54) DIELECTRIC RESONATOR DEVICES, DIELECTRIC FILTERS AND DIELECTRIC DUPLEXERS

(75) Inventors: Toshitaka Suma, Daito (JP); Hiroyuki Taguchi, Daito (JP); Masahisa Nakaguchi, Katano (JP)

(73) Assignees: Sanyo Electric Co., Ltd., Osaka (JP); Sanyo Electronic Components Co., Ltd., Osaka (JP)

( * ) Notice: Subject to any disclaimer, the term of this patent is extended or adjusted under 35 U.S.C. 154(b) by 14 days.

(21) Appl. No.: 10/197,544

(22) Filed: Jul. 18, 2002

(65) Prior Publication Data

US 2003/0030514 A1 Feb. 13, 2003

(30) Foreign Application Priority Data

Aug. 10, 2001 (JP) ..... 2001-243579
Jan. 22, 2002 (JP) ..... 2002-012251

(51) Int. Cl.[7] ..... H01P 1/20

(52) U.S. Cl. ..... 333/206; 333/202; 333/222; 333/101

(58) Field of Search ..... 333/206, 202, 333/101, 207, 134, 222, 219, 123, 258, 262, 81 A

(56) References Cited

U.S. PATENT DOCUMENTS 5,227,748 A * 7/1993 Sroka ..... 333/207
5,250,916 A 10/1993 Zakman
5,293,141 A * 3/1994 Kobayashi et al. ..... 333/206
5,365,209 A 11/1994 Ito et al.
5,541,560 A * 7/1996 Turunen et al. ..... 333/207
5,883,554 A * 3/1999 Takeuchi et al. ..... 333/202
6,085,071 A * 7/2000 Yamada et al. ..... 455/82
6,191,668 B1 * 2/2001 Takeuchi et al. ..... 333/202
6,359,529 B1 * 3/2002 Tsunoda et al. ..... 333/101
6,556,101 B1 * 4/2003 Tada et al. ..... 333/134

FOREIGN PATENT DOCUMENTS

| | | |
|---|---|---|
| JP | 62-44566 | 11/1987 |
| JP | 6-283904 | 10/1994 |
| JP | 7-147503 | 6/1995 |
| JP | 9-83214 | 3/1997 |
| JP | 11-168302 | 6/1999 |

* cited by examiner

*Primary Examiner*—Brian Young
*Assistant Examiner*—John Nguyen
(74) *Attorney, Agent, or Firm*—Armstrong, Kratz, Quintos, Hanson & Brooks, LLP.

(57) ABSTRACT

The invention provides a dielectric resonator device comprising a coaxial dielectric resonator 2 which comprises a dielectric block 21 having a bore 22 extending therethrough, an outer conductor layer 24 formed on an outer peripheral surface of the dielectric block 21, an inner conductor layer 23 formed on the dielectric block 21 over an inner peripheral surface thereof defining the bore 22, a short-circuiting conductor layer 25 providing a short circuit between the outer conductor layer 24 and the inner conductor layer 23, and a separated conductor layer 3 formed on the outer peripheral surface of the dielectric block 21 and electrically separated from the outer conductor layer 24. The separated conductor layer 3 is connected to the ground by a switch SW, which varies the capacity of the resonator 2 upon switching to alter the resonance frequency thereof.

15 Claims, 39 Drawing Sheets

DIELECTRIC RESONATOR DEVICES, DIELECTRIC FILTERS AND DIELECTRIC DUPLEXERS

FIELD OF THE INVENTION

The present invention relates to dielectric resonator devices, dielectric filters and dielectric duplexers for use in communications devices, image devices, etc.

BACKGROUND OF THE INVENTION

Mobile communications systems using a frequency band of hundreds of megahertz to several gigahertz have terminal devices comprising a receiving circuit 52 and a transmitting circuit 62 which are connected in parallel with an antenna 7 via a duplexer 72 to use the single antenna 7 for both the receiving circuit 52 and the transmitting circuit 62 as shown in FIG. 35. The duplexer 72 comprises a receiving filter 50 and a transmitting filter 60, each of which is provided, for example, by a coaxial dielectric resonator 20 shown in FIG. 38.

With reference to FIG. 38, the coaxial dielectric resonator 20 comprises a rectangular parallelepipedal dielectric block 21 having a bore 22 extending therethrough, an outer conductor layer 24 and an inner conductor layer 23 which are formed on the dielectric block 21 respectively over the outer peripheral surface thereof and the inner peripheral surface thereof defining the bore 22, and a short-circuiting conductor layer 25 formed on the dielectric block 21 over an end face thereof where the bore 22 has an opening and providing a short circuit between the outer conductor layer 24 and the inner conductor layer 23.

With reference to FIG. 39(*a*) showing the coaxial dielectric resonator 20, the outer conductor layer 24 is connected to the ground, and the inner conductor layer 23 to a signal input terminal S, whereby the coaxial dielectric resonator 20 is made equivalent to a circuit comprising an inductance element and a capacitance element which are connected in parallel with each other as shown in FIG. 39(*b*), thus providing a trap filter having a resonance frequency which is determined by the inductance of the inductance element L and the capacitance of the capacitance element C.

Terminal devices which are usable for a plurality of communications systems of different frequency bands are required of mobile communications systems. Accordingly, it has been proposed to use a dielectric resonator device shown in FIG. 37 (see, for example, JP-A No. 7-147503/1995) for the receiving filter 50 and transmitting filter 60.

The dielectric resonator device is provided by connecting a switch SW to the point of connection between the inner conductor layer 23 of the coaxial dielectric resonator 20 and the signal input terminal S, via an external capacitor element C0, such that the capacitance C0 of the external capacitor element can be connected to or disconnected from a capacitance C provided between the outer conductor layer 24 of the resonator 20 and the inner conductor layer 23 thereof by operating the switch SW. The resonance frequency of the resonator 20 alters with the variation of capacity effected by switching.

FIG. 36 shows an arrangement of a receiving filter 50 and a transmitting filter 60 each comprising such a dielectric resonator device. As illustrated, the receiving filter 50 has a signal line extending from a receiving connection terminal 51 to an antenna terminal 71, and a plurality of capacitance elements C4, C5 and C6 provided on the signal line. The transmitting filter 60 has a signal line extending from a transmitting connection terminal 61 to the antenna terminal 71, and a plurality of capacitance elements C4', C5' and C6' provided on the signal line. Two coaxial dielectric resonators 20, 20 are connected to each of the signal lines. A switch SW is connected via a capacitance element C0 to the point of connection between each resonator 20 and the signal line. Accordingly, the pass bands of the receiving filter 50 and the transmitting filter 60 can be altered for a changeover between two kinds of receiving/transmitting frequencies by operating these switches SW.

It has been demanded in recent years that mobile communications terminal devices, such as portable telephones, be made ever smaller in size, giving rise to the great problem of how to reduce the number of electric or electronic components and how to diminish the sizes of such components. However, the dielectric resonator device shown in FIG. 37 has the problem that the need to connect the external capacitor C0 in the form of a chip to the coaxial dielectric resonator 20 increases the number of components of the device and makes the device large-sized. Further since chip capacitors are great in capacity tolerance, the capacitor requires an additional circuit (not shown) for finely adjusting the capacity, hence a further increase in the number of components.

SUMMARY OF THE INVENTION

An object of the present invention is to provide a dielectric resonator device having a resonance frequency which is accurately variable without necessitating an external capacitor, and a dielectric filter and a dielectric duplexer which comprise the resonator device.

The present invention provides a dielectric resonator device comprising a coaxial dielectric resonator 2 which comprises a dielectric block 21 having a bore 22 extending therethrough, an outer conductor layer 24 formed on an outer peripheral surface of the dielectric block 21, an inner conductor layer 23 formed on the dielectric block 21 over an inner peripheral surface thereof defining the bore 22, a short-circuiting conductor layer 25 formed on the dielectric block 21 over an end face thereof where the bore 22 has an opening and providing a short circuit between the outer conductor layer 24 and the inner conductor layer 23, and a separated conductor layer 3 formed on the outer peripheral surface of the dielectric block 21 and electrically separated from the outer conductor layer 24.

The separated conductor layer 3 of the resonator 2 has connected thereto a switch SW by which the capacitance C' provided between the separated conductor layer 3 and the inner conductor layer 23 is connected to or disconnected from the capacitance C provided between the outer conductor layer 24 and the inner conductor layer 23 upon switching to thereby vary the resonance frequency of the resonator 2.

With the dielectric resonator device of the invention, the inner conductor layer 3 of the resonator 2 is connected, for example, to a signal input terminal S, and the outer conductor layer 24 is connected to the ground.

With the device described above, the separated conductor layer 3 on the outer peripheral surface of the dielectric block 21 of the resonator 2 is opposed to the inner conductor layer 23, providing a capacitance C' between the two layers. The capacitance C' is connected to or disconnected from the capacitance C between the outer conductor layer 24 and the inner conductor layer 23 by operating the switch SW, thus performing the same function as a conventional external capacitor.

Stated more specifically, the separated conductor layer 3 of the resonator 2 is connected to the ground via the switch SW. Accordingly, when closed, the switch SW connects the separated conductor layer 3 to the ground, whereby the capacitance C' between the separated conductor layer 3 and the inner conductor layer 23 is connected to the capacitance C between the outer conductor layer 24 and the inner conductor layer 23 to shift the resonance frequency of the resonator 2 toward the lower frequency side. Alternatively when opened, the switch SW cuts off the separated conductor layer 3 from the ground, with the result that the capacitance C' between the separated conductor layer 3 and the inner conductor layer 23 becomes no longer involved in the resonance frequency of the resonator 2 to shift the resonance frequency toward the higher frequency side.

Further stated more specifically, the separated conductor layer 3 of the resonator 2 is provided by forming a groove 26 in the outer conductor layer 24 covering the outer peripheral surface of the dielectric block 21 and separating off a portion of the outer conductor layer 24. The groove 26 can be formed, for example, by ultrasonic machining. The resonance frequency of the resonator 20 can be made to match the designed value with high accuracy by finely adjusting the area of the separated conductor layer 3 during machining of the groove 26.

Further stated more specifically, the separated conductor layer 3 comprises a first separated conductor layer 31 and a second separated conductor layer 32 which are electrically separated from each other, the first separated conductor layer 31 being connected to an input signal terminal S, the second separated conductor layer 32 being connected to the ground via the switch SW, the outer conductor layer 24 being connected to the ground. With this specific construction, a capacitance C' is provided between the second separated conductor layer 32 and the inner conductor layer 23, and a capacitance C" is provided between the first separated conductor layer 31 and the inner conductor layer 23. Accordingly, when a high-frequency signal to be input to the inner conductor layer 23 is input to the first separated conductor layer 31, the input signal is input to the inner conductor layer 23 through the capacitance C". As a result, the wire for feeding the input signal to the inner conductor layer 23 can be dispensed with.

The present invention provides a dielectric filter comprising a first dielectric resonator device 11 and a second dielectric resonator device 12 which are connected to, and located respectively at two positions on, a signal line extending from an input terminal 42 to an output terminal 43, at least one of the dielectric resonator devices comprising the coaxial dielectric resonator 2 of the invention described. The separated conductor layer 3 of the resonator 2 has connected thereto a switch SW by which the capacitance C' provided between the separated conductor layer 3 and the inner conductor layer 23 is connected to or disconnected from the capacitance C provided between the outer conductor layer 24 and the inner conductor layer 23 upon switching to thereby give altered signal passage characteristics.

The present invention provides a dielectric duplexer comprising a receiving filter 5 and a transmitting filter 6 which are connected in parallel with an antenna terminal 71 for connecting an antenna 7 thereto, each of the receiving filter 5 and the transmitting filter 6 comprising the coaxial dielectric resonators of the invention described. The separated conductor layer 3 of the resonator 2 has connected thereto a switch SW by which the capacitance C' provided between the separated conductor layer 3 and the inner conductor layer 23 is connected to or disconnected from the capacitance C provided between the outer conductor layer 24 and the inner conductor layer 23 upon switching to thereby alter the signal passage characteristics of the receiving filter 5 or the transmitting filter 6.

The present invention provides another dielectric duplexer comprising a receiving filter 54 and a transmitting filter 64 which are connected in parallel with an antenna terminal 71 for connecting an antenna 7 thereto, the receiving filter 54 comprising a main filter circuit 82 having a pass band in the frequency band of the signal to be received and a trap circuit 83 connected in series with the main filter circuit 82 for attenuating the frequency band of the signal to be transmitted, the trap circuit 83 comprising the coaxial dielectric resonator 2 of the invention described. The separated conductor layer 3 of the resonator 2 has connected thereto a switch SW by which the capacitance C' provided between the separated conductor layer 3 and the inner conductor layer 23 is connected to or disconnected from the capacitance C provided between the outer conductor layer 24 and the inner conductor layer 23 upon switching to thereby alter the signal passage characteristics of the receiving filter 54.

With the dielectric resonator device, the dielectric filter and the dielectric duplexer according to the invention, the coaxial dielectric resonator 2 itself is provided with a capacitance for varying the resonance frequency as described above, so that the resonance frequency can be altered without necessitating an external capacitor. Further the coaxial dielectric resonator 2 can be set at a designed resonance frequency with high accuracy by finely adjusting the area of the separated conductor layer 3.

DETAILED DESCRIPTION OF EMBODIMENTS

Figure 1:
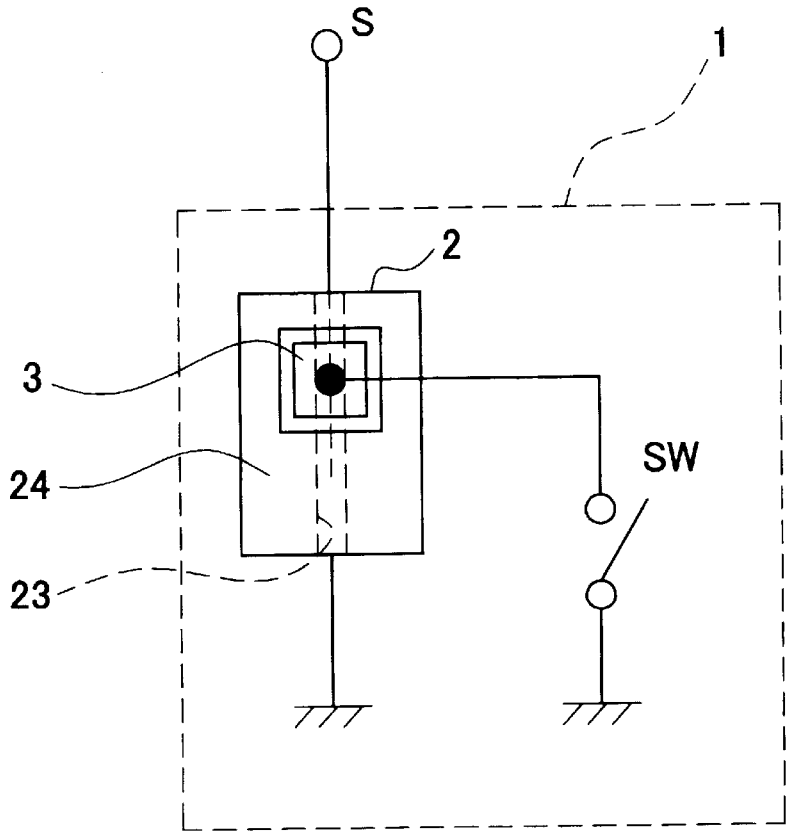
FIG. 1 is a diagram showing the construction of a dielectric resonator device according to the invention.

Embodiments of the present invention will be described below in detail with reference to the drawings. FIG. 1 shows the construction of a dielectric resonator device 1 according to the invention. The device 1 comprises a coaxial dielectric resonator 2, and a switch SW for varying the resonance frequency thereof.

Figure 2:
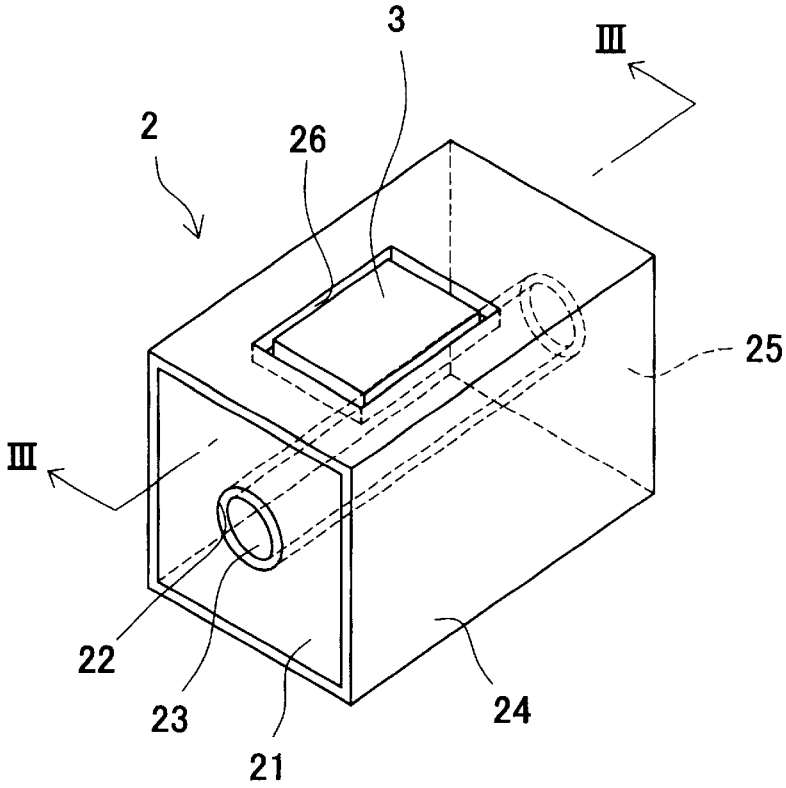
FIG. 2 is a perspective view of a coaxial dielectric resonator constituting the device.
Figure 3:
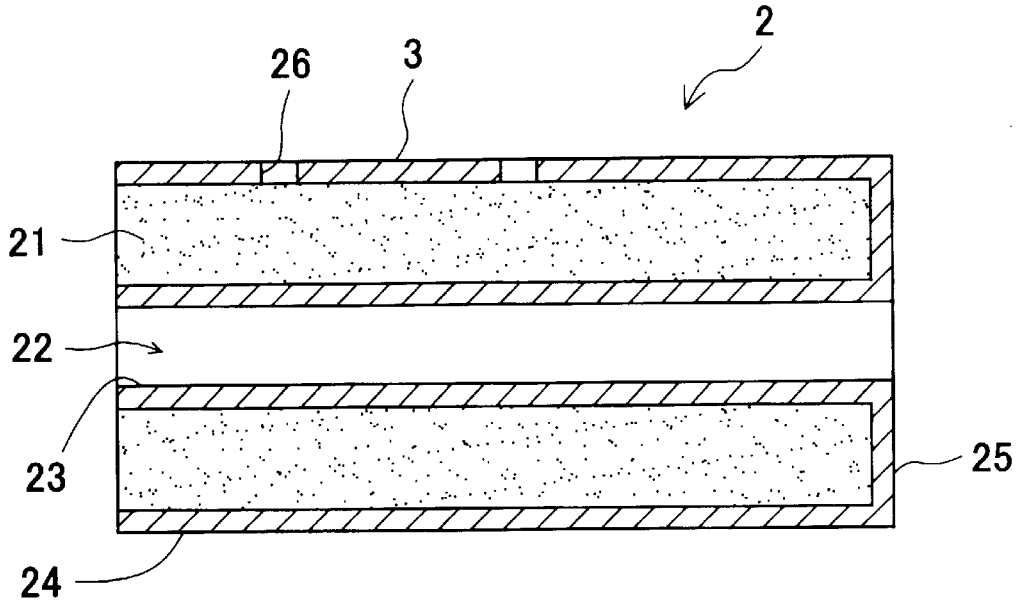
FIG. 3 is a view in section of the resonator.

With reference to FIGS. 2 and 3, the resonator 2 comprises a rectangular parallelepipedal dielectric block 21 made from a ceramic material such as $BaTiO_3$ or the like. The dielectric block 21 has a bore 22 centrally extending therethrough. The block 21 is covered with an outer conductor layer 24 over the outer peripheral surface thereof and with an inner conductor layer 23 over the inner peripheral surface thereof defining the bore 22. The block 21 is further covered with a short-circuiting conductor layer 25 over one end face thereof in which the bore 22 has an opening for providing a short circuit between the outer conductor layer 24 and the inner conductor layer 23. A square groove 26 is formed as by ultrasonic machining in the outer conductor layer 24 covering the outer peripheral surface of the dielectric block 21 to provide inside the groove 26 a separated conductor layer 3 electrically separated from the outer conductor layer 24.

With the dielectric resonator device 1 shown in FIG. 1, the separated conductor layer 3 of the resonator 2 is connected to the ground via a switch SW. For example, a diode is usable for the switch SW. A signal input terminal S is connected to the inner conductor layer 23 of the resonator 2. The outer conductor layer 24 of the resonator device 1 is connected to the ground.

Figure 23:
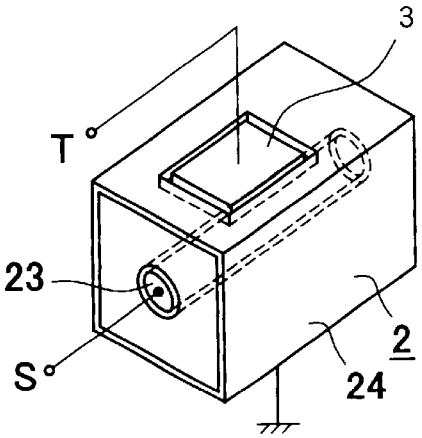
FIG. 23 is a diagram showing an equivalent circuit of the coaxial dielectric resonator shown in FIG. 2.
Figure 23:
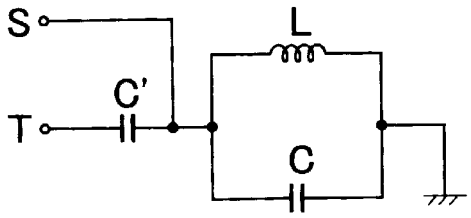

FIGS. 23(*a*), (*b*) show the resonator device 1 and an equivalent circuit thereof. A capacitance C' provided between the separated conductor layer 3 and the inner conductor 23 is connected in series with a circuit comprising an inductance element L and a capacitance element C connected in parallel with each other, by connecting a terminal T connected to the separated conductor layer 3 to the ground.

With the resonator device 1 described, the switch SW, when closed, connects the separated conductor layer 3 to the ground, whereby the capacitance C' between the separated conductor layer 3 and the inner conductor layer 23 is connected to the capacitance C between the outer conductor layer 24 and the inner conductor layer 23 to increase the capacity of the resonator 2. Alternatively when opened, the switch SW cuts off the separated conductor layer 3 from the ground, with the result that the capacitance C' between the separated conductor layer 3 and the inner conductor layer 23 no longer functions to reduce the capacity of the resonator 2. Thus, the capacity of the resonator 2 is altered by operating the switch SW to thereby alter the resonance frequency of the resonator 2. The external capacitor conventionally used can therefore be dispensed with.

In fabricating the resonator device 1, the separated conductor layer 3 is formed by forming the outer conductor layer 24 over the entire area of the outer peripheral surface of the dielectric block 21 and thereafter forming a groove 26 in the layer 24 as by ultrasonic machining, so that the area of the separated conductor layer 3 can be adjusted as desired with high accuracy when the groove 26 is machined. In this way, the resonance frequency of the resonator 2 can be made to match the specified designed value.

Figure 4:
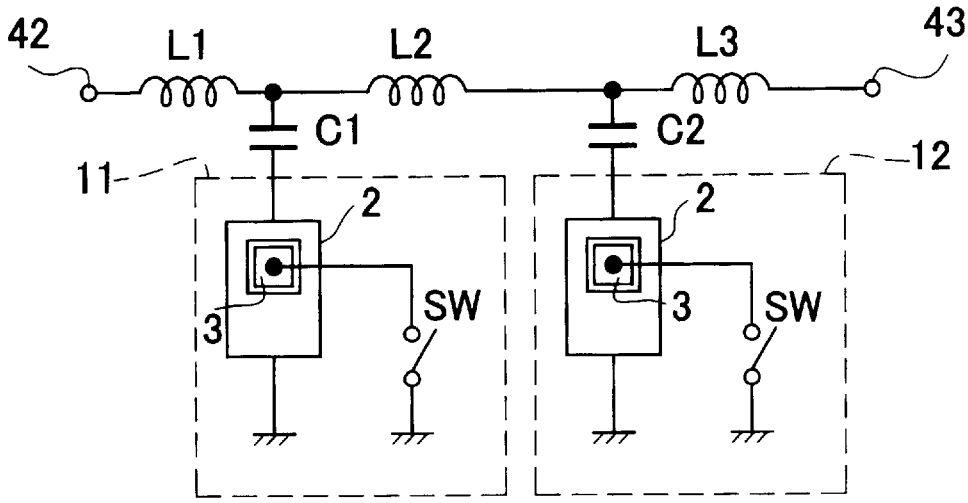
FIG. 4 is a diagram showing the construction of a dielectric filter of the invention comprising such resonator devices.

FIG. 4 shows the construction of an exemplary dielectric filter comprising a trap circuit provided by the coaxial dielectric resonator 2 described. As illustrated, a first inductance element L1, a second inductance element L2 and a third inductance element L3 are provided on a signal line extending from an input terminal 42 to an output terminal 43. A first dielectric resonator device 11 is connected via a coupling first capacitance element C1 to the point of connection between the first inductance element L1 and the second inductance element L2. A second dielectric resonator device 12 is connected via a coupling second capacitance element C2 to the point of connection between the second inductance element L2 and the third inductance element L3. The first and second resonator devices 11, 12 each have the same construction as the device 1 shown in FIG. 1.

Figure 8:
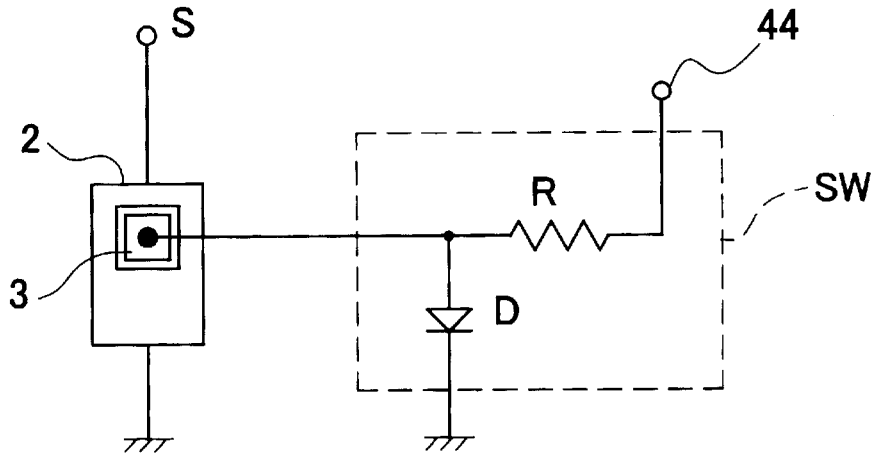
FIG. 8 is a circuit diagram showing the specific construction of a switch.

As shown in FIG. 8, the switch SW constituting the first and second resonator devices 11, 12 comprises a diode D and a resistor R, and the switch SW can be opened or closed by changing the voltage to be applied to a control terminal 44.

Figure 5:
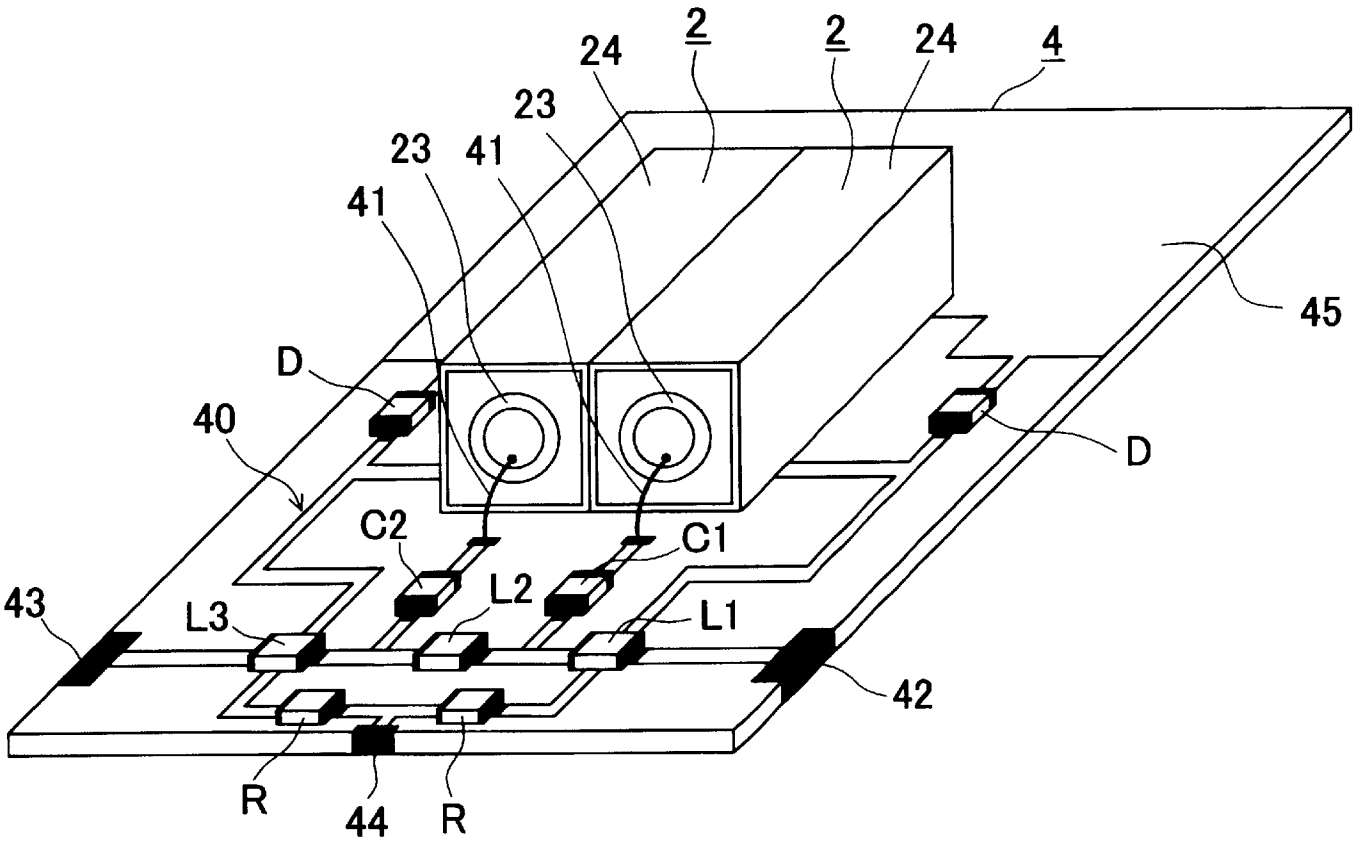
FIG. 5 is a perspective view showing the actual construction of the dielectric filter.
Figure 6:
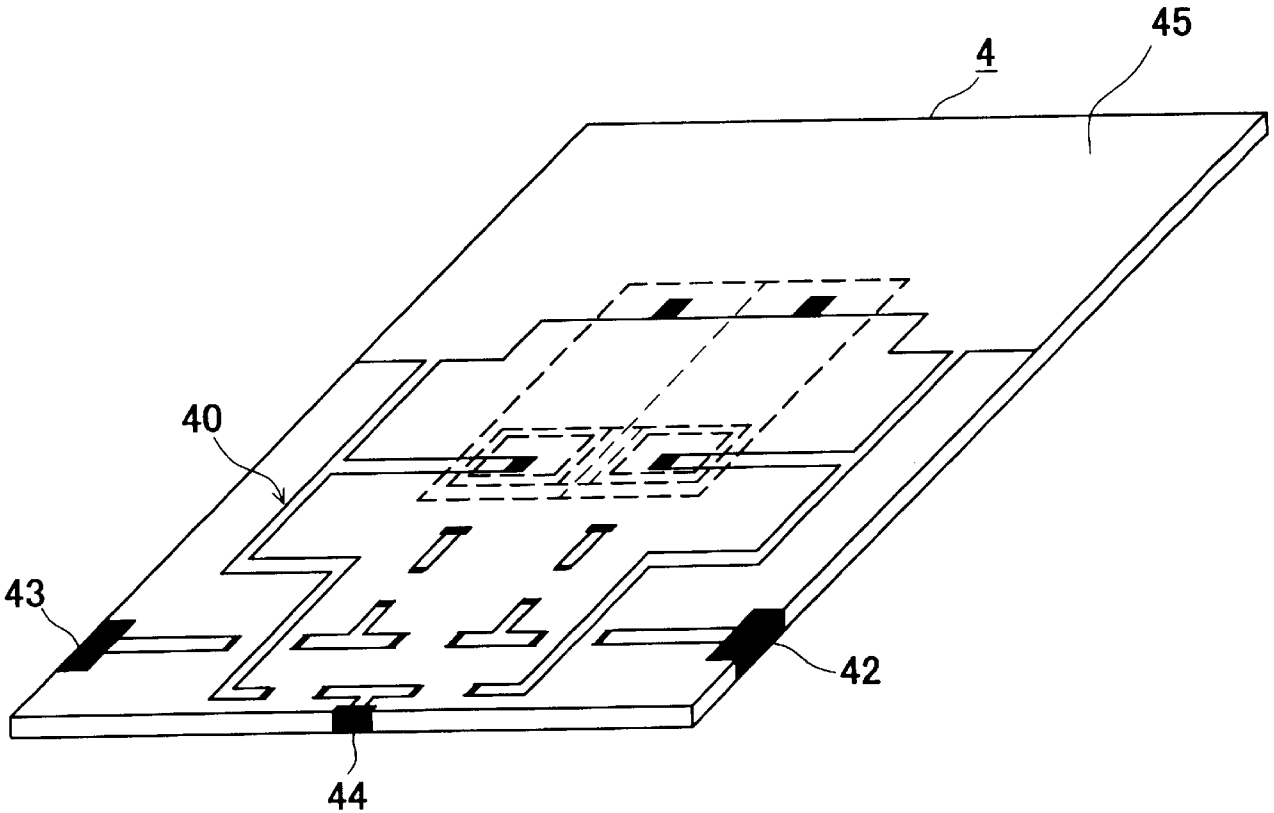
FIG. 6 is a perspective view of a circuit board for use in the dielectric filter.
Figure 7:
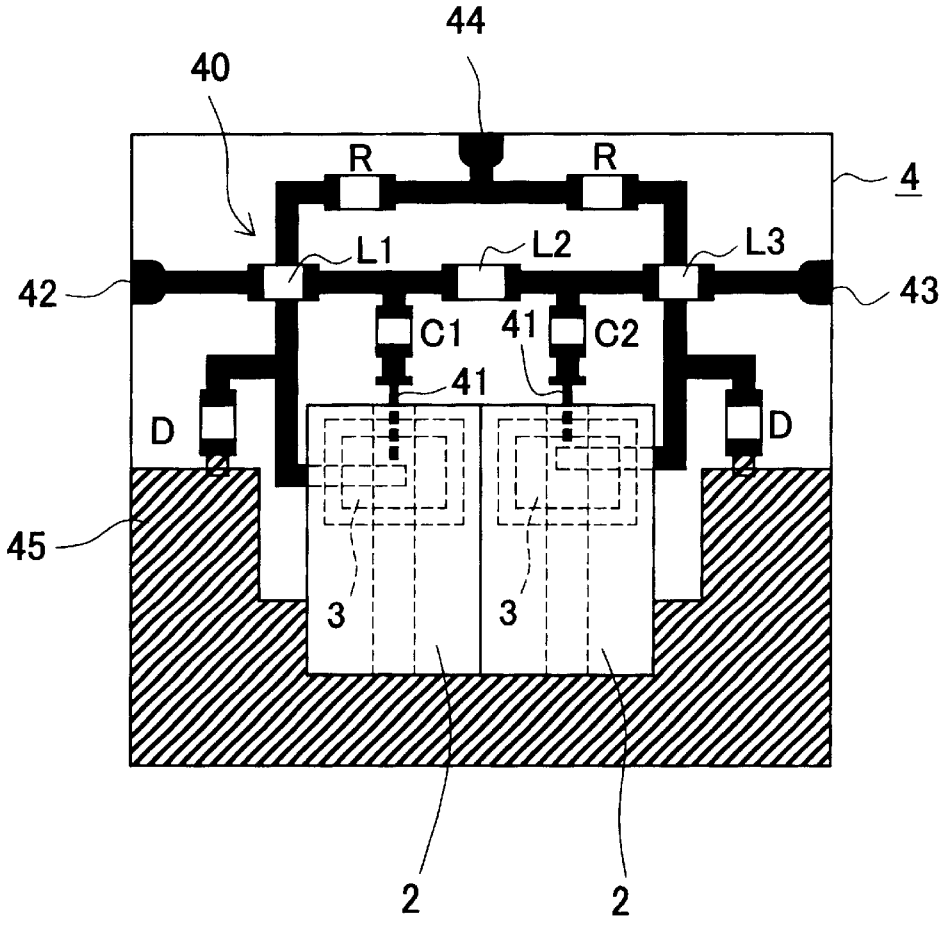
FIG. 7 is a plan view of the dielectric filter.

FIGS. 5 to 7 show the dielectric filter described, as actually built on a circuit board 4. As shown in FIG. 6, the circuit board 4 is provided with a conductor pattern 40 including the input terminal 42, output terminal 43, control terminal 44 and grounding electrode pattern 45. The area where the grounding electrode pattern 45 is formed is indicated in FIG. 7 by hatching. Arranged on the conductor pattern 40 as shown in FIG. 5 are coaxial dielectric resonators 2, 2, first to third inductance elements L1, L2, L3, first and second capacitance elements C1, C2, diodes D, D and resistors R, R. The two resonators 2, 2 are each fixed to the circuit board 4, with the separated conductor layer bearing sides thereof in contact with the surface of the board. Conductor patterns extending from the first and second capacitance elements C1, C2 are connected to the respective inner conductor layers 23 of the resonators 2 by wires 41.

Figure 12:
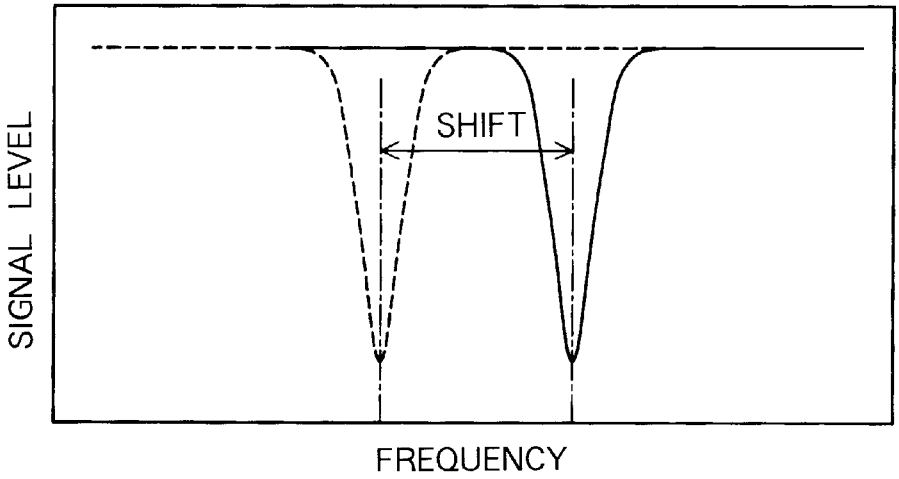
FIG. 12 is a graph showing the signal pass characteristics of the dielectric filter shown in FIG. 4.

With the dielectric filter described, the voltage to be applied to the control terminal 44 is changed to open or close the switches SW of the resonator devices 11, 12 at the same time, whereby the resonance frequency of the resonator devices 11, 12 can be altered. Indicated in a solid line in FIG. 12 are signal pass characteristics when the switches SW are opened, and in a broken line are those when the switches are closed. In this way, the signal pass characteristics of the dielectric filter can be shifted toward the lower frequency side or higher frequency side.

Figure 9:
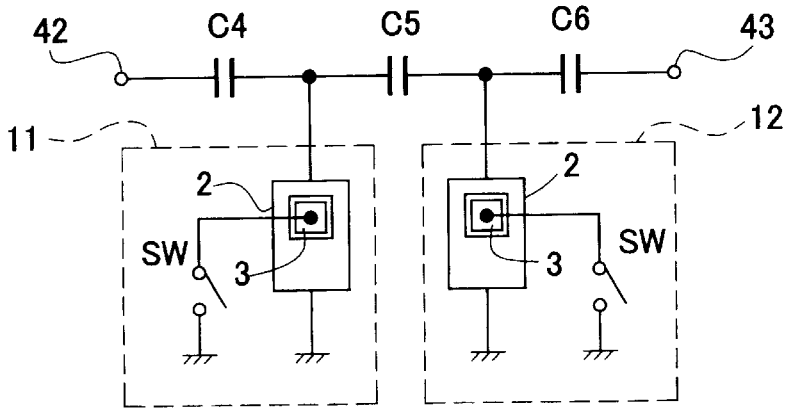
FIG. 9 is a diagram showing the construction of another dielectric filter of the invention.

FIG. 9 shows the construction of another embodiment of dielectric filter comprising the coaxial dielectric resonator 2 described. As illustrated, a first capacitance element C4, a second capacitance element C5 and a third capacitance element C6 are provided on a signal line extending from an input terminal 42 to an output terminal 43. A first dielectric resonator device 11 is connected to the point of connection between the first capacitance element C4 and the second capacitance element C5. A second dielectric resonator device 12 is connected to the point of connection between the second capacitance element C5 and the third capacitance element C6. The first and second resonator devices 11, 12 each have the same construction as the device 1 shown in FIG. 1.

Figure 10:
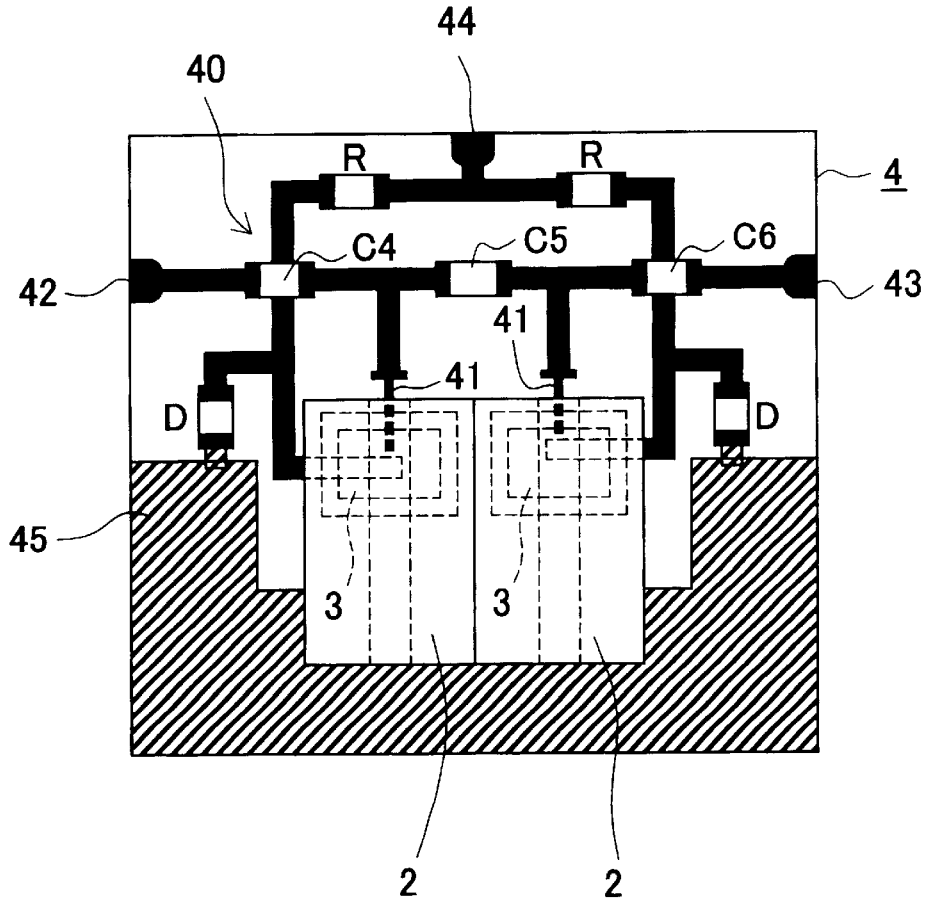
FIG. 10 is a plan view showing the specific construction of the dielectric filter.

FIG. 10 shows the dielectric filter described, as actually built on a circuit board 4. The circuit board 4 is provided with a conductor pattern 40 including the input terminal 42, output terminal 43, control terminal 44 and grounding electrode pattern 45. Arranged on the conductor pattern 40 are coaxial dielectric resonators 2, 2, first to third capacitance elements C4, C5, C6, diodes D, D and resistors R, R. The two resonators 2, 2 are fixed to the circuit board 4, with the separated conductor layer bearing sides thereof in contact with the surface of the board. A conductor pattern extending from the point of connection between the first and second capacitance elements C4, C5 is connected to the inner conductor layer 23 of one of the resonators 2 by a wire 41. A conductor pattern extending from the point of connection between the second and third capacitance elements C5, C6 is connected to the inner conductor layer 23 of the other resonator 2 by a wire 41.

Figure 13:
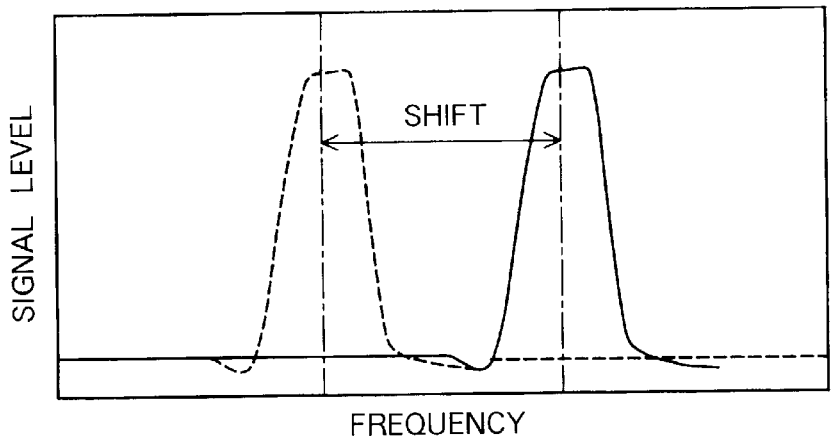
FIG. 13 is a graph showing the signal pass characteristics of the dielectric filter shown in FIG. 9.

With the dielectric filter described, the voltage to be applied to the control terminal 44 is changed to open or close the switches SW of the resonator devices 11, 12 at the same time, whereby the resonance frequency of the resonator devices 11, 12 can be altered. Indicated in a solid line in FIG. 13 are signal pass characteristics when the switches SW are opened, and in a broken line are those when the switches are closed. In this way, the signal pass characteristics of the dielectric filter can be shifted toward the lower frequency side or higher frequency side.

Figure 11:
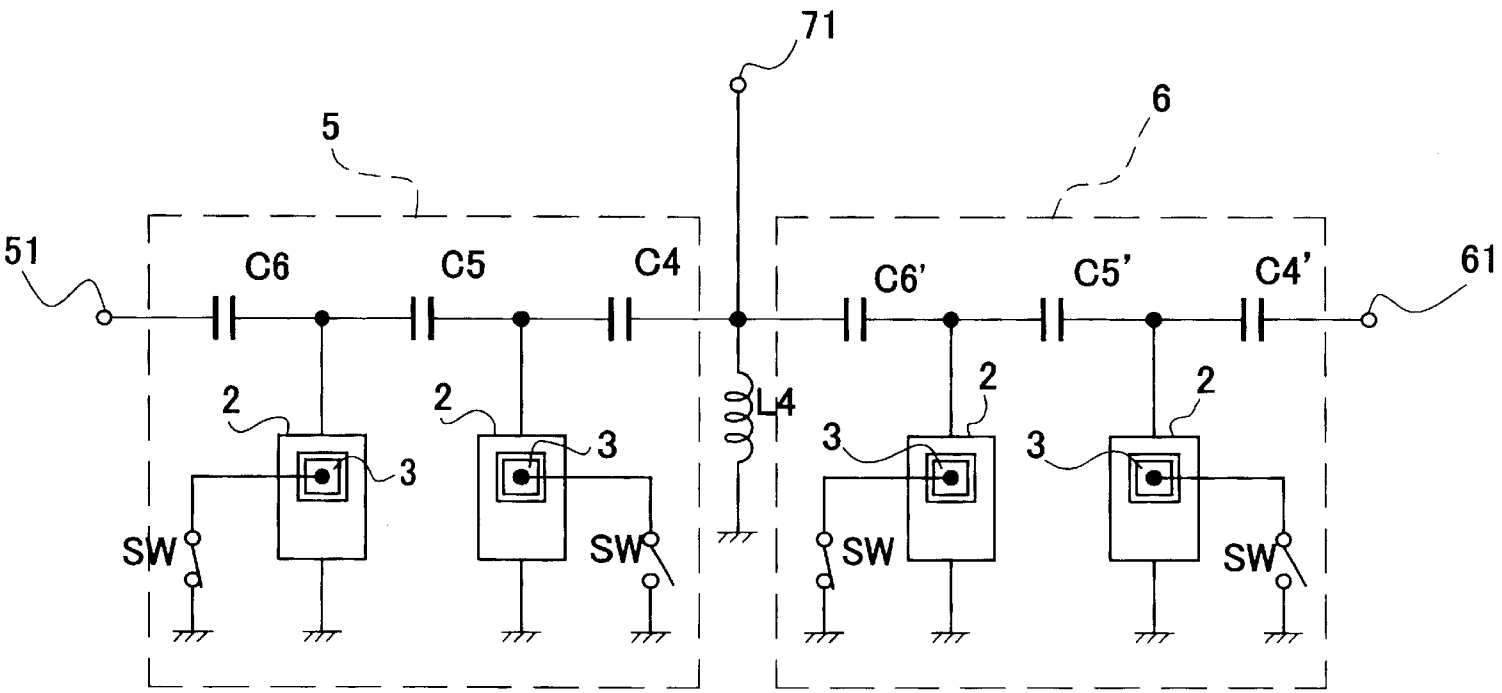
FIG. 11 is a diagram showing the construction of a dielectric duplexer of the invention.

FIG. 11 shows the construction of a dielectric duplexer comprising the dielectric filter described. As illustrated, a receiving filter 5 and a transmitting filter 6 are connected in parallel with an antenna terminal 71. Each of the filters 5, 6 comprises the dielectric filter shown in FIG. 9. The point of connection between the receiving filter 5 and the transmitting filter 6 is connected to the ground via a fourth inductance L4, which diminishes the unnecessary low-frequency components.

Figure 14:
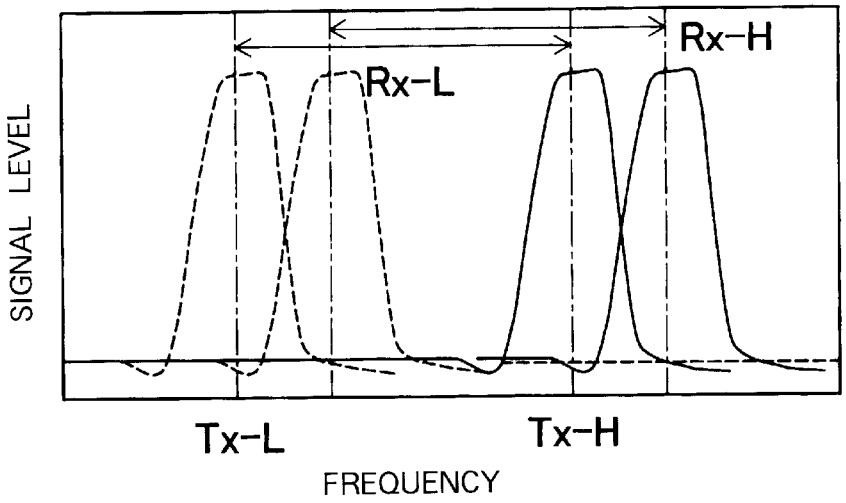
FIG. 14 is a graph showing the signal pass characteristics of the dielectric duplexer shown in FIG. 11.

With the duplexer described, the switches SW of the filters 5, 6 are operated at the same time, whereby the signal pass characteristics of the two filters 5, 6 can be altered. Indicated in solid lines in FIG. 14 are the signal pass characteristics Rx-H, Tx-H of the receiving filter 5 and the transmitting filter 6 when the switches SW are opened, and in broken lines are the signal pass characteristics Rx-L, Tx-L of the filters 5, 6 when the switches SW are closed.

In this way, the frequency bands of the signal to be received and the signal to be transmitted can be shifted toward the higher frequency side or lower frequency side by operating the switches SW. This makes it possible to provide mobile communications terminal devices usable for two communications systems which are different in frequency band.

Figure 15:
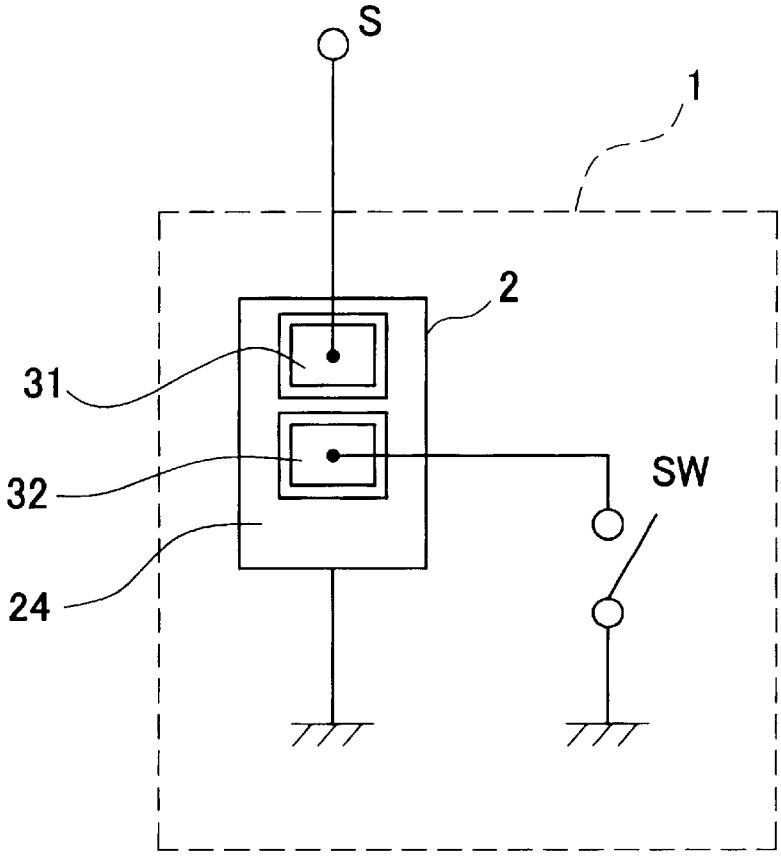
FIG. 15 is a diagram showing the construction of another dielectric resonator device of the invention.
Figure 16:
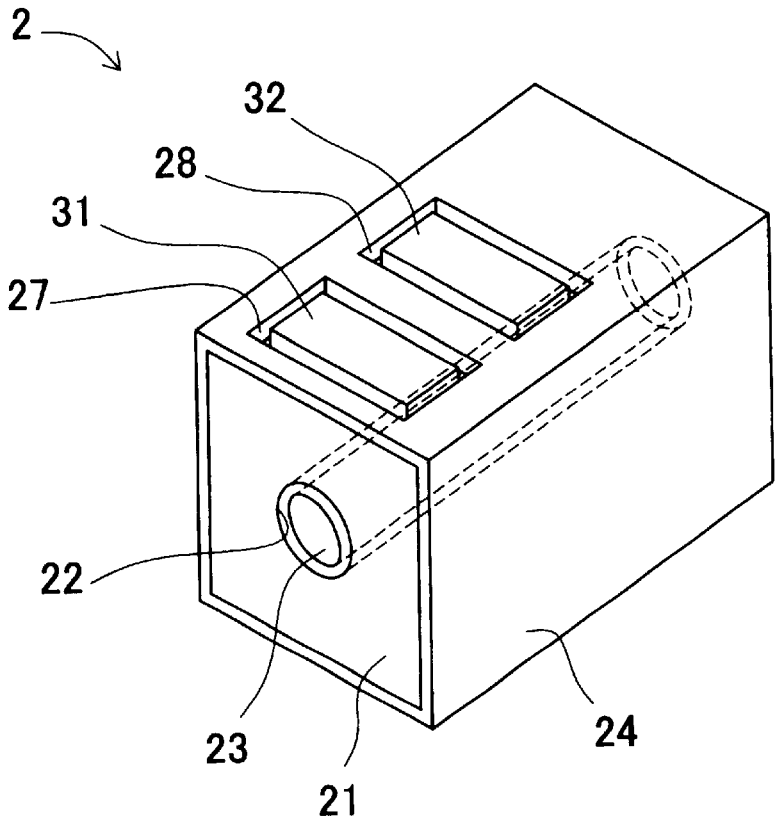
FIG. 16 is a perspective view of a coaxial dielectric resonator constituting the device.

FIG. 15 shows the construction of another dielectric resonator device 1 according to the invention. The device 1 comprises a coaxial dielectric resonator 2, and a switch SW for varying the resonance frequency thereof. With reference to FIG. 16, the resonator 2 comprises a rectangular parallelepipedal dielectric block 21 having a bore 22 centrally extending therethrough. The block 21 is covered with an outer conductor layer 24 over the outer peripheral surface thereof and with an inner conductor layer 23 over the inner peripheral surface thereof defining the bore 22. The block 21 is further covered with a short-circuiting conductor layer 25 over one end face thereof in which the bore 22 has an opening for providing a short circuit between the outer conductor layer 24 and the inner conductor layer 23.

A first rectangular groove 27 and a second rectangular groove 28 are formed as by ultrasonic machining in the outer conductor layer 24 covering the outer peripheral surface of the dielectric block 21 to provide inside the respective grooves 2, 28 a first separated conductor layer 31 and a second separated conductor layer 32 which are electrically separated from the outer conductor layer 24.

With the dielectric resonator device 1 shown in FIG. 15, the second separated conductor layer 32 of the resonator 2 is connected to the ground via a switch SW. A signal input terminal S is connected to the first separated conductor layer 31 of the resonator 2. The outer conductor layer 24 of the resonator device 1 is connected to the ground.

Figure 24:
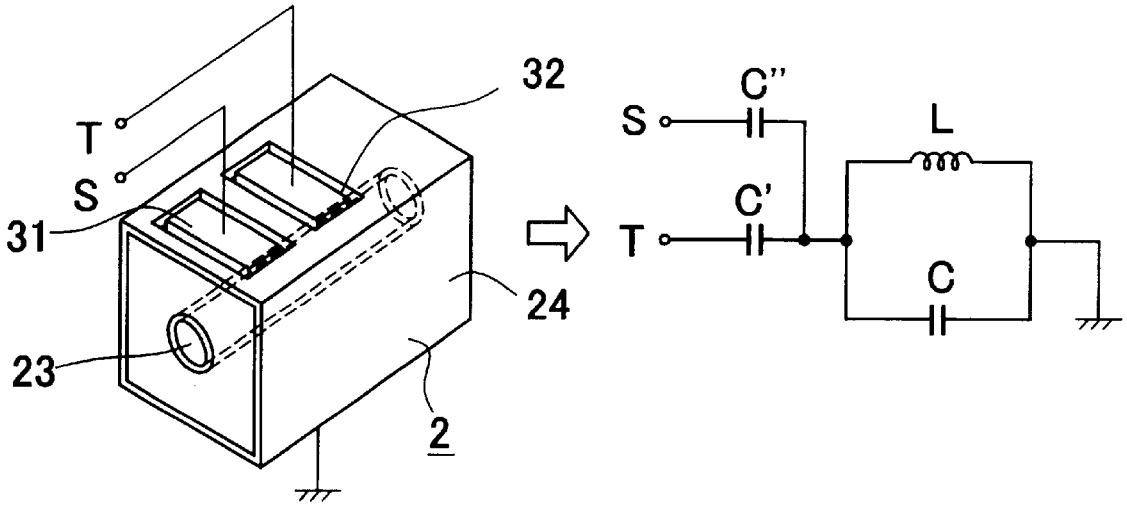
FIG. 24 is a diagram showing an equivalent circuit of the coaxial dielectric resonator shown in FIG. 16.

FIGS. 24(*a*), (*b*) show the resonator device 1 and an equivalent circuit thereof. A capacitance C' provided between the second separated conductor layer 32 and the inner conductor layer 23 and a capacitance C" provided between the first separated conductor layer 31 and the inner conductor layer 23 are connected to a circuit comprising an inductance element L and a capacitance element C which are connected in parallel with each other, by connecting a terminal T connected to the second separated conductor layer 32 to the ground.

With the resonator device 1 described, the switch SW, when closed, connects the second separated conductor layer 32 to the ground, whereby the capacitance C' between the second separated conductor layer 32 and the inner conductor layer 23 is connected to the capacitance C between the outer conductor layer 24 and the inner conductor layer 23 to increase the capacity of the resonator 2. Alternatively when opened, the switch SW cuts off the second separated conductor layer 32 from the ground, with the result that the capacitance C' between the second separated conductor layer 32 and the inner conductor layer 23 no longer functions to reduce the capacity of the resonator 2. Thus, the capacity of the resonator 2 is altered by operating the switch SW to thereby alter the resonance frequency of the resonator 2. The external capacitor conventionally used can therefore be dispensed with.

With the resonator device 1, a capacitance C' is provided between the second separated conductor layer 32 and the inner conductor layer 23, and a capacitance C" between the first separated conductor layer 31 and the inner conductor layer 23 as shown in FIGS. 24(*a*) and (*b*), so that when the high-frequency signal to be input to the inner conductor 23 is input to the first separated conductor layer 31, the input signal is input to the inner conductor layer 23 through the capacitor C". This eliminates the need for a wire for feeding the input signal to the inner conductor layer 23.

Figure 17:
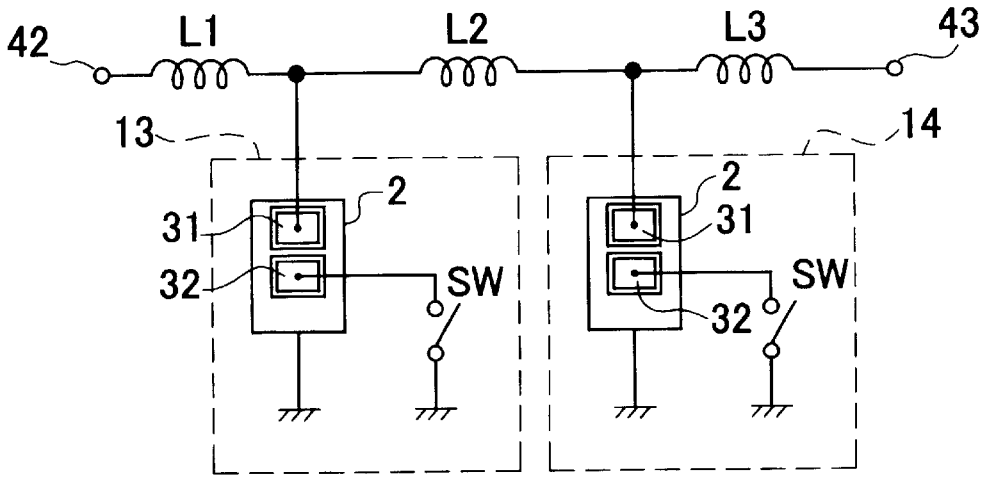
FIG. 17 is a diagram showing the construction of a dielectric filter of the invention comprising such resonator devices.

FIG. 17 shows the construction of an exemplary dielectric filter comprising the coaxial dielectric resonator 2 described. As illustrated, a first inductance element L1, a second inductance element L2 and a third inductance element L3 are provided on a signal line extending from an input terminal 42 to an output terminal 43. A first dielectric resonator device 13 is connected to the point of connection between the first inductance element L1 and the second inductance element L2. A second dielectric resonator device 14 is connected to the point of connection between the second inductance element L2 and the third inductance element L3. The first and second resonator devices 13, 14 each have the same construction as the device 1 shown in FIG. 15.

The switches SW constituting the first and second resonator devices 13, 14, like the switch SW shown in FIG. 8, comprise a diode D and a resistor R, and the switches SW can be opened or closed by changing the voltage to be applied to a control terminal 44.

Figure 18:
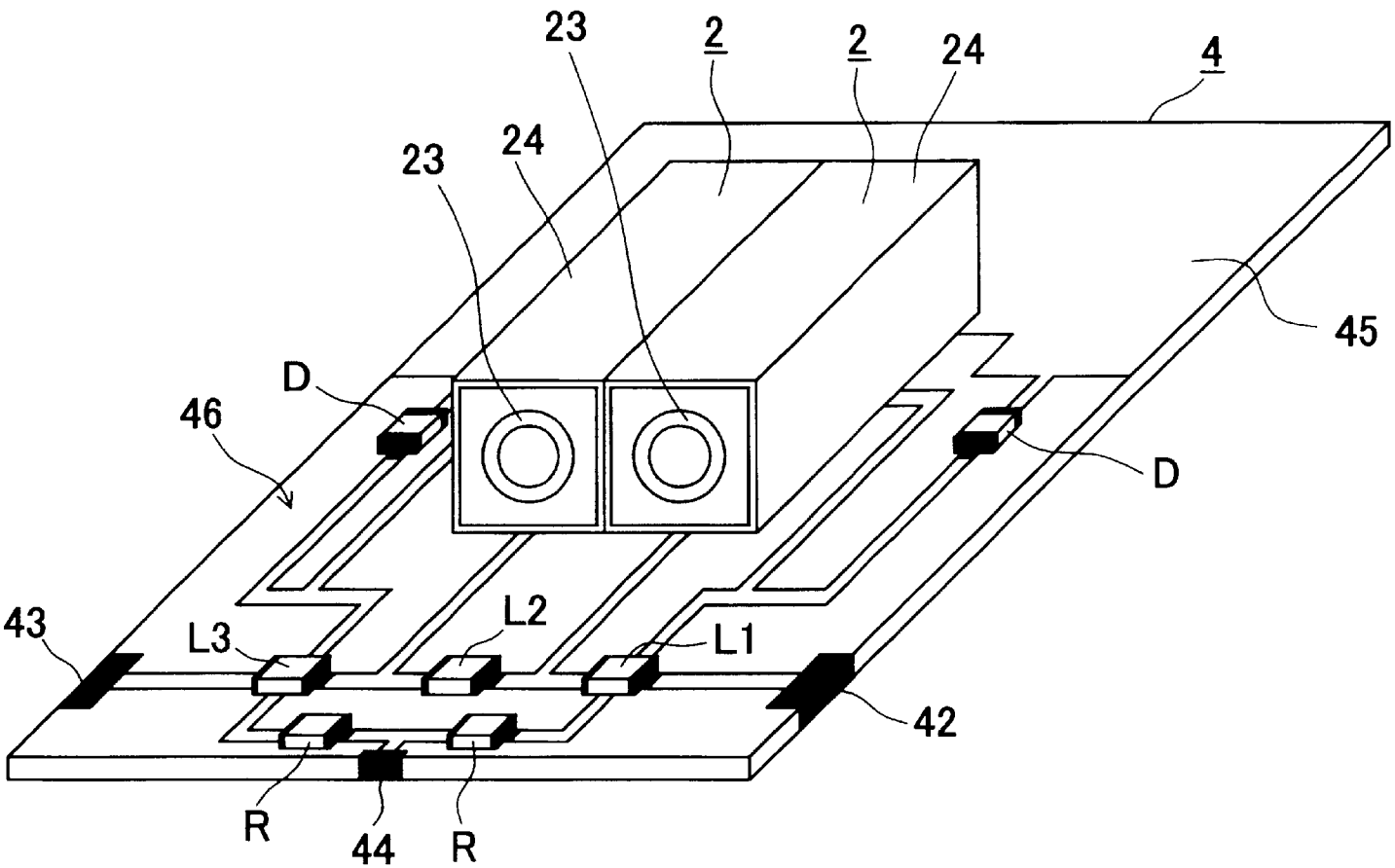
FIG. 18 is a perspective view showing the actual construction of the dielectric filter.
Figure 19:
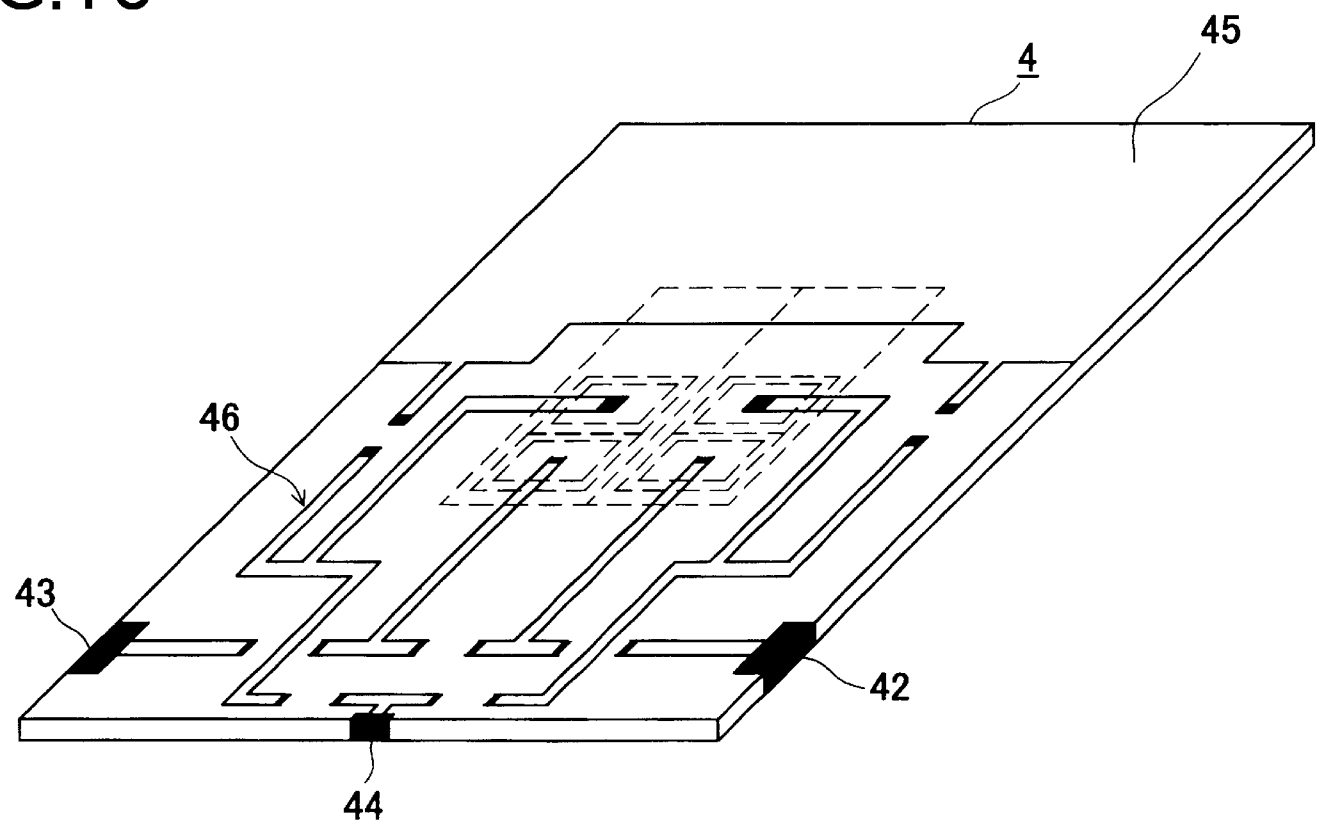
FIG. 19 is a perspective view of a circuit board for use in the dielectric filter.
Figure 20:
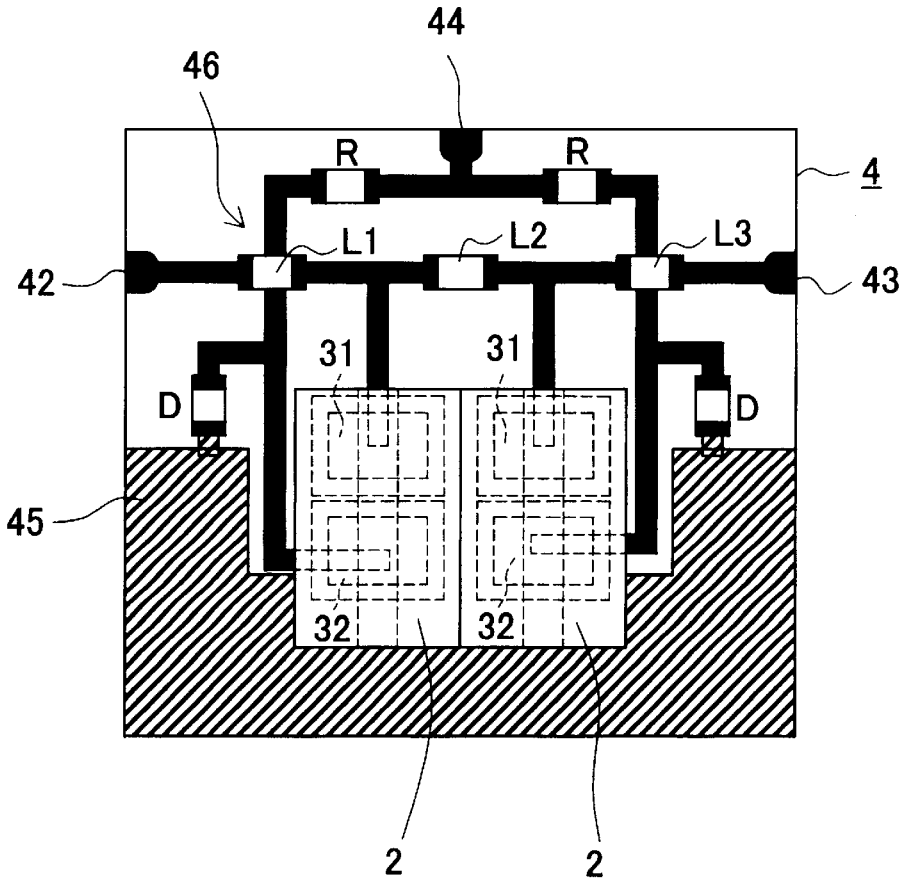
FIG. 20 is a plan view of the dielectric filter.

FIGS. 18 to 20 show the dielectric filter described, as actually built on a circuit board 4. As shown in FIG. 19, the circuit board 4 is provided with a conductor pattern 46 including the input terminal 42, output terminal 43, control terminal 44 and grounding electrode pattern 45. The area where the grounding electrode pattern 45 is formed is indicated in FIG. 20 by hatching. Arranged on the conductor pattern 46 as shown in FIG. 18 are coaxial dielectric resonators 2, 2, first to third inductance elements L1, L2, L3, diodes D, D and resistors R, R. The two resonators 2, 2 are fixed to the circuit board 4, with the separated conductor layer bearing sides thereof in contact with the surface of the board.

With the dielectric filter described, the voltage to be applied to the control terminal 44 is changed to open or close the switches SW of the first and second resonator devices 13, 14 at the same time, whereby the resonance frequency of the resonator devices 13, 14 can be altered to shift the signal pass characteristics of the dielectric filter toward the lower frequency side or higher frequency side.

The construction shown in FIG. 24(*a*) is used for the dielectric resonator devices 13, 14 in the dielectric filter described, so that the input signal for the resonator 2 is fed to the first separated conductor layer 31. This eliminates the need for the wire for feeding the input signal to the inner conductor layer 23 as shown in FIG. 18.

Further as shown in FIGS. 24(*a*), (*b*), the capacitance C" is provided between the first separated conductor layer 31 of the resonator 2 and the inner conductor layer 23 thereof, and this capacitance C" serves the function of a coupling capacitance. Accordingly, the dielectric filter shown in FIG. 17 need not be provided with the coupling capacitance elements C1, C2 required for the dielectric filter shown in FIG. 4.

Figure 21:
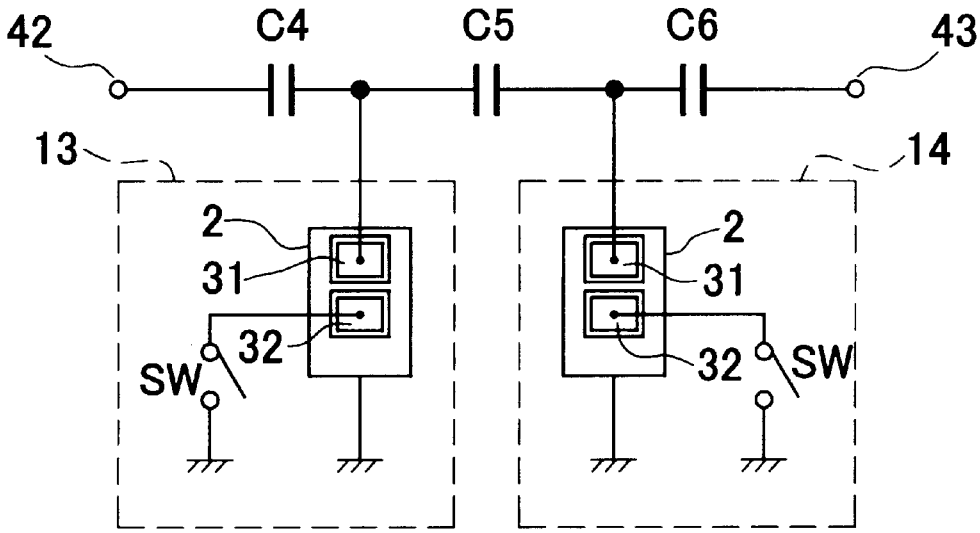
FIG. 21 is a diagram showing the construction of another dielectric filter of the invention.

FIG. 21 shows the construction of another embodiment of dielectric filter comprising the coaxial dielectric resonator 2 described. As illustrated, a first capacitance element C4, a second capacitance element C5 and a third capacitance element C6 are provided on a signal line extending from an input terminal 42 to an output terminal 43. A first dielectric resonator device 13 is connected to the point of connection between the first capacitance element C4 and the second capacitance element C5. A second dielectric resonator device 14 is connected to the point of connection between the second capacitance element C5 and the third capacitance element C6. The first and second resonator devices 13, 14 each have the same construction as the device 1 shown in FIG. 15.

Figure 22:
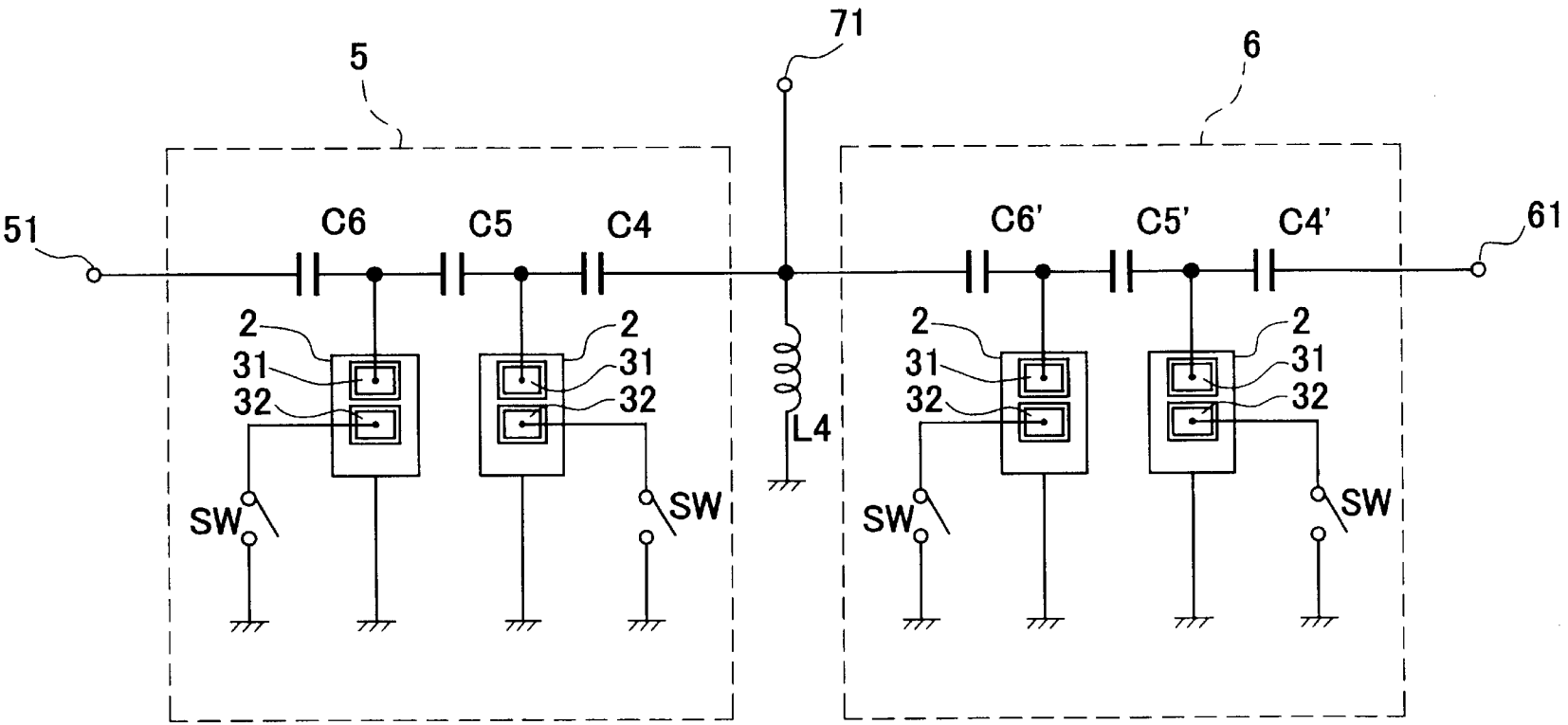
FIG. 22 is a diagram showing the construction of another dielectric duplexer of the invention.

FIG. 22 shows the construction of a dielectric duplexer comprising the dielectric filter described. As illustrated, a receiving filter 5 and a transmitting filter 6 are connected in parallel with an antenna terminal 71. Each of the filters 5, 6 comprises the dielectric filter shown in FIG. 17.

With the duplexer described, the switches SW of the filters 5, 6 are operated at the same time, whereby the signal pass characteristics of the two filters 5, 6 can be shifted toward the higher frequency side or lower frequency side. This makes it possible to provide mobile communications terminal devices usable for two communications systems which are different in frequency band.

Figure 25:
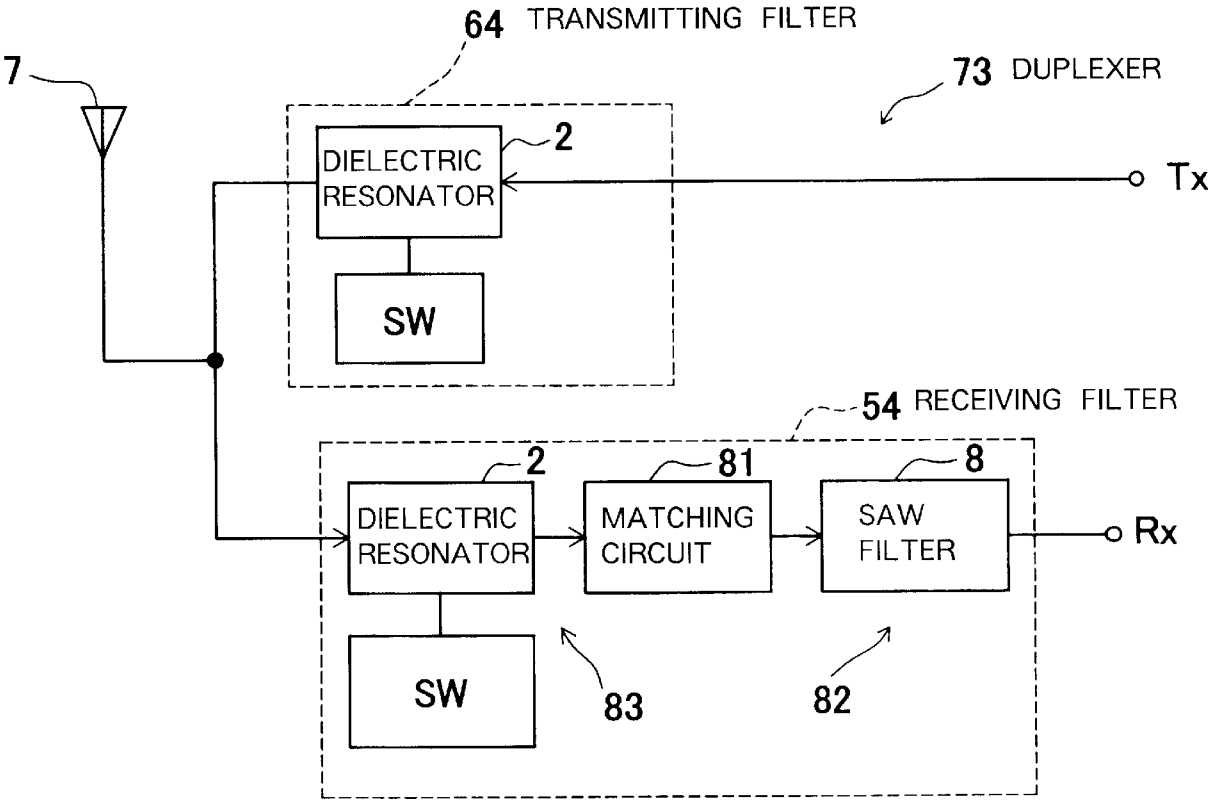
FIG. 25 is a diagram showing the construction of another dielectric duplexer of the invention.

FIG. 25 shows the construction of another duplexer 73 according to the invention. Connected to an antenna 7 as illustrated are a transmitting filter 64 having a pass band in the frequency band of the signal to be transmitted and an attenuation band in the frequency band of the signal to be received, and a receiving filter 54 having a pass band in the frequency band of the signal to be received and an attenuation band in the frequency band of the signal to be transmitted.

Figure 26:
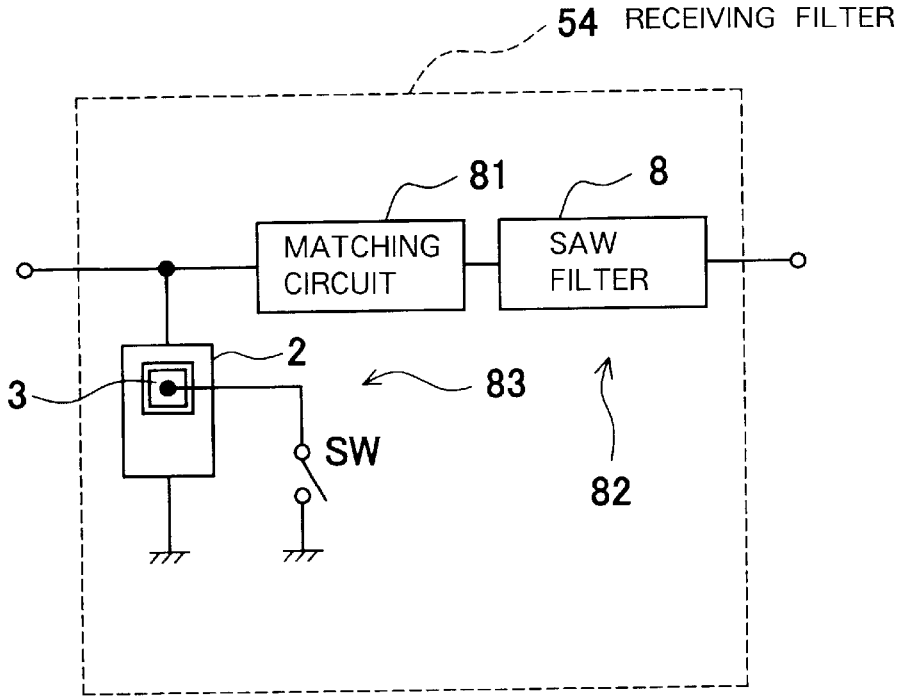
FIG. 26 is a diagram showing the construction of a receiving filter constituting the dielectric duplexer.
Figure 27:
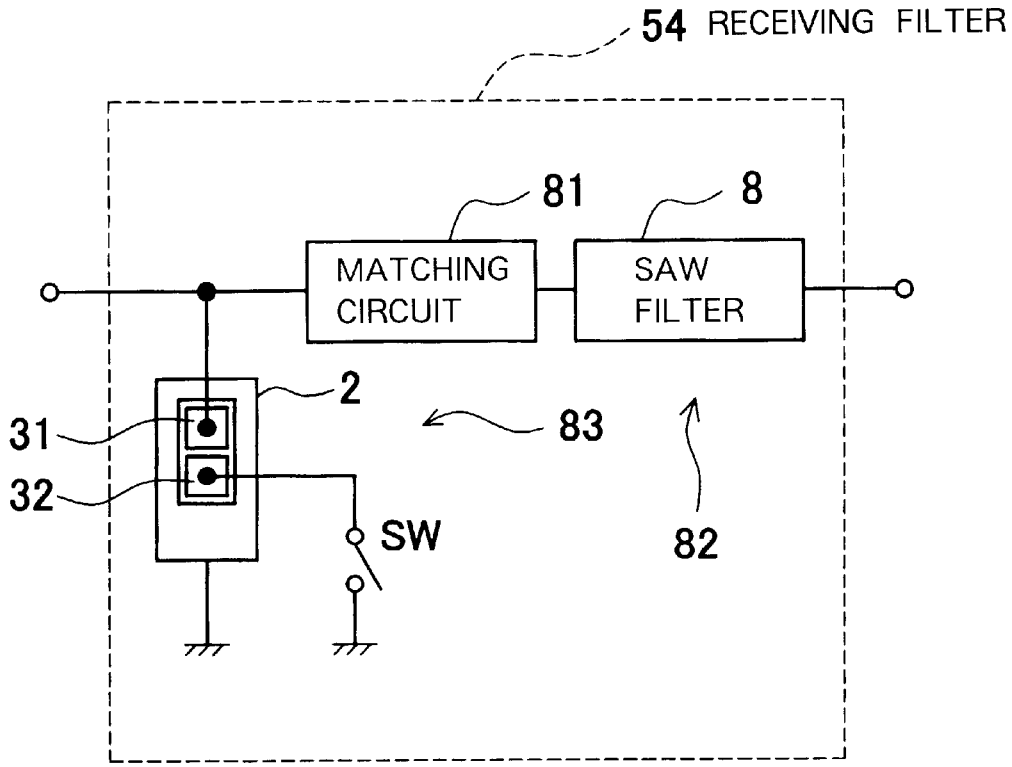
FIG. 27 is a diagram showing the construction of another receiving filter constituting the dielectric duplexer.

The transmitting filter 64 is provided by connecting a switch SW to the coaxial dielectric resonator 2 described. On the other hand, the receiving filter 54 comprises a main filter circuit 82 having a pass band in the frequency band of the signal to be received, a matching circuit 81, and a trap circuit 83 for attenuating the frequency band of the signal to be transmitted, these circuits 82, 81, 83 being connected in series. The main filter circuit 82 comprises, for example, a known surface acoustic wave filter 8 comprising interdigital input electrode and output electrode which are provided on a substrate of $LiTaO_3$. The trap circuit 83 comprises a dielectric filter of the invention provided by connecting a switch SW to a coaxial dielectric resonator 2. Usable as the resonator 2 constituting the trap circuit 83 is one comprising a single separated conductor layer 3 as shown in FIG. 26, or one comprising a first separated conductor layer 31 and a second separated conductor layer 32 as shown in FIG. 27.

Figure 28:
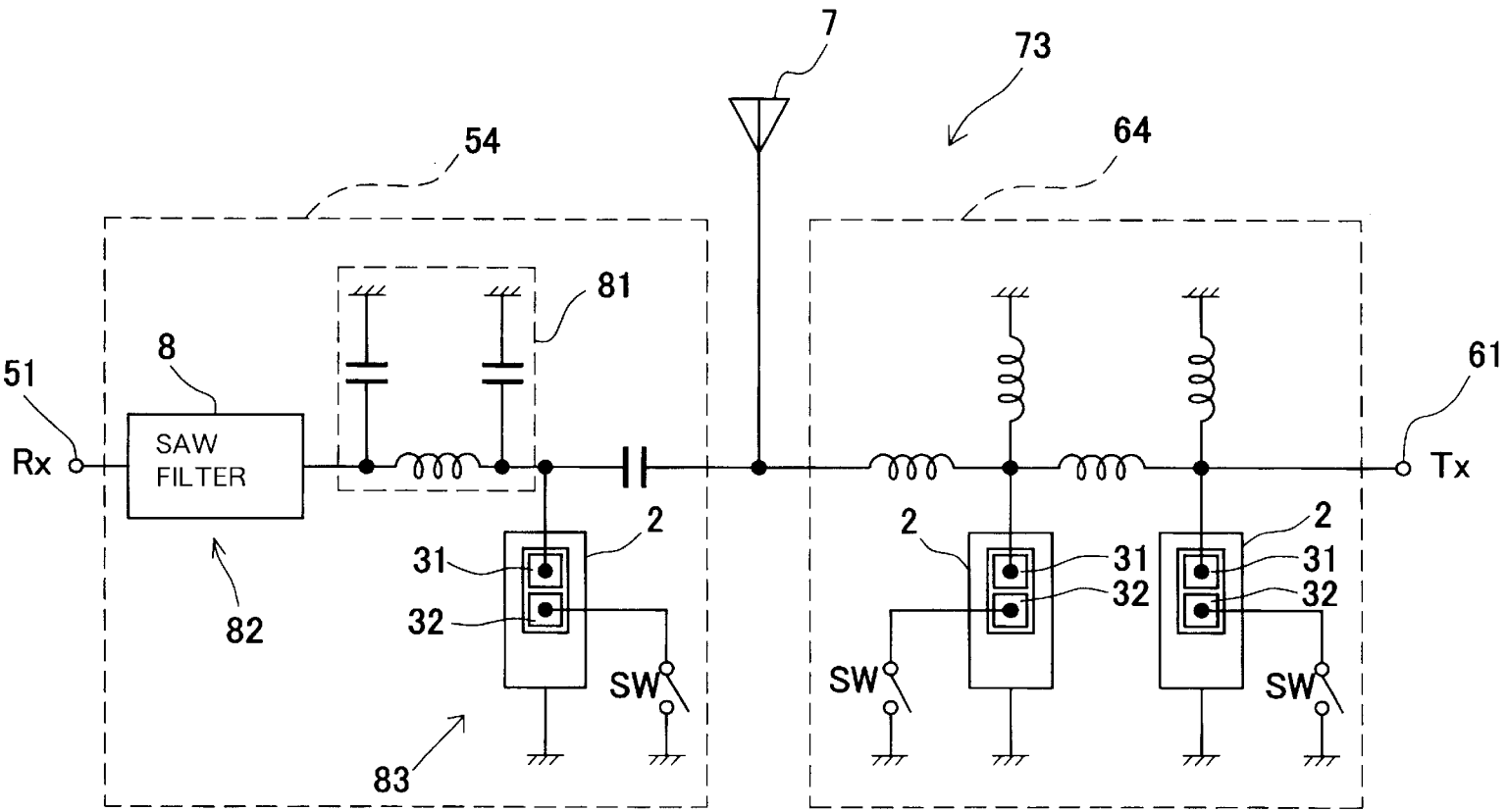
FIG. 28 is a diagram showing the specific construction of the dielectric duplexer.

FIG. 28 shows the specific construction of the duplexer 73 according to the invention. As illustrated, the receiving filter 54 is provided by connecting a main filter circuit 82 comprising a SAW filter 8, a matching circuit 81 and a trap circuit 83 of the invention comprising a coaxial dielectric resonator 2 and a switch SW, to a signal line extending from a receiving connection terminal 51 to an antenna 7. On the other hand, the transmitting filter 64 comprises a signal line extending from a transmitting connection terminal 61 to the antenna 7, and a dielectric resonator device of the invention composed of a coaxial dielectric resonator 2 and a switch SW and connected to the signal line at each of two positions thereon.

With the duplexer 73 described above, the switches SW of the receiving filter 54 and the transmitting filter 64 are operated to shift the signal pass characteristics of the filters 54, 64. With the receiving filter 54, the impedance of the main filter circuit 82 and that of the trap circuit 83 are made to match by the matching circuit 81, so that the signal pass characteristics of the receiving filter 54 are the combination of the signal pass characteristics of the main filter circuit 82 and those of the trap circuit 83.

Figure 32:
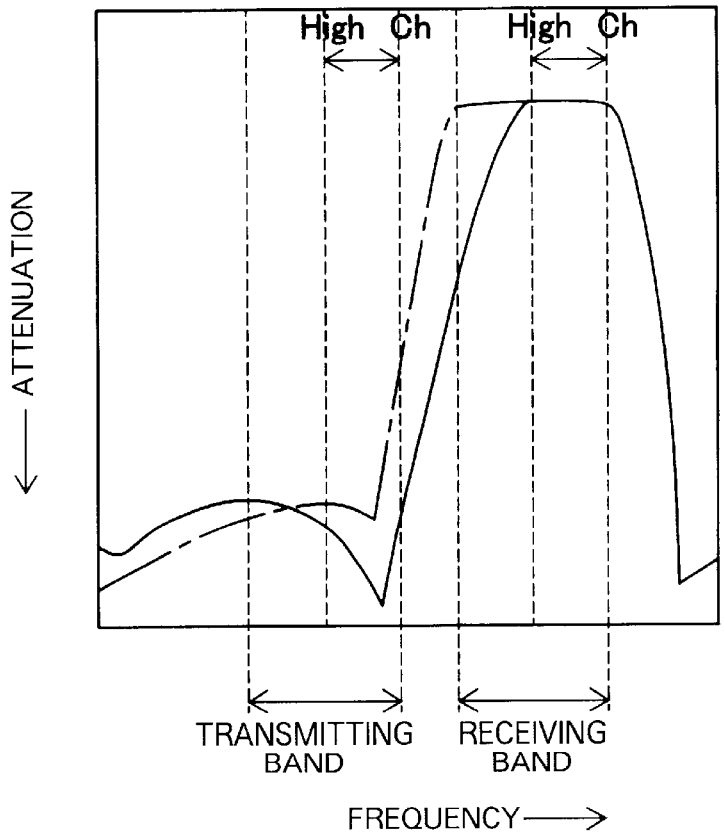
FIG. 32 is a graph showing the signal pass characteristics of the receiving filter when the switch is opened.
Figure 33:
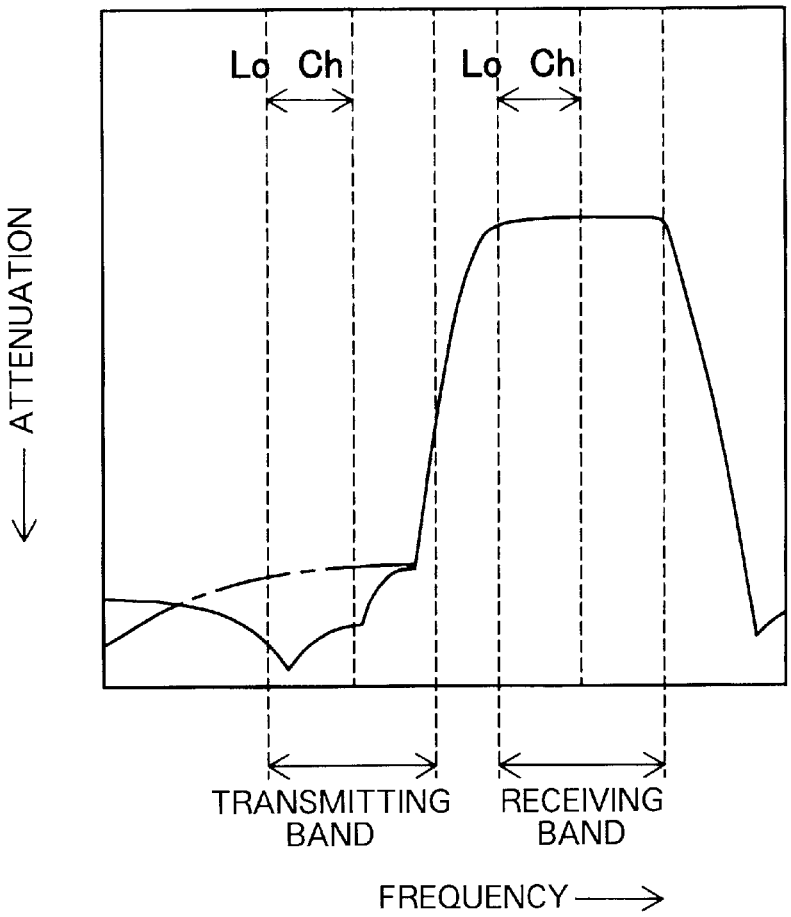
FIG. 33 is a graph showing the signal pass characteristics of the receiving filter when the switch is closed.

Indicated in a solid line in FIG. 32 are the signal pass characteristics of the receiving filter 54 when the switches SW are open. Indicated in a solid line in FIG. 33 are the signal pass characteristics of the receiving filter 54 when the switches SW are closed. Indicated in chain lines in FIGS. 32 and 33 are the signal pass characteristics of the main filter circuit 82 alone of the receiving filter 54.

Figure 34:
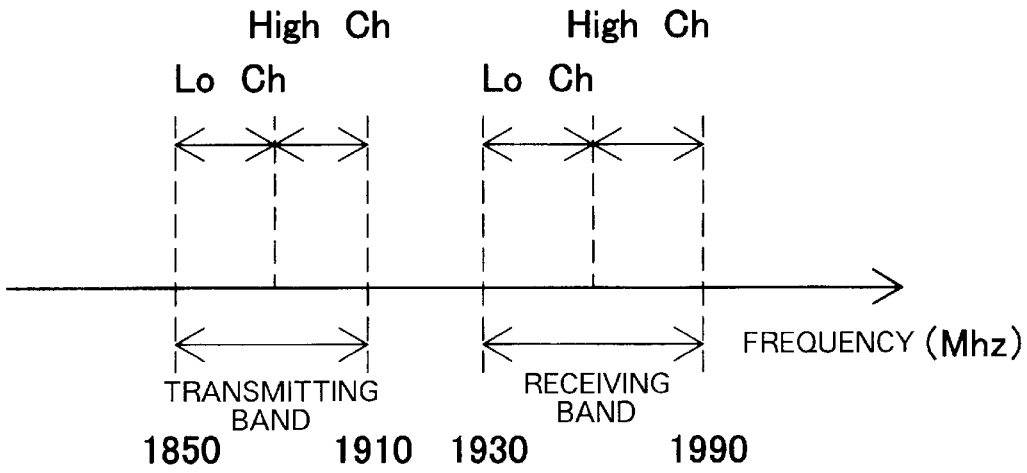
FIG. 34 is a diagram for illustrating the transmitting and receiving bands of CDMA1900 system.
Figure 35:
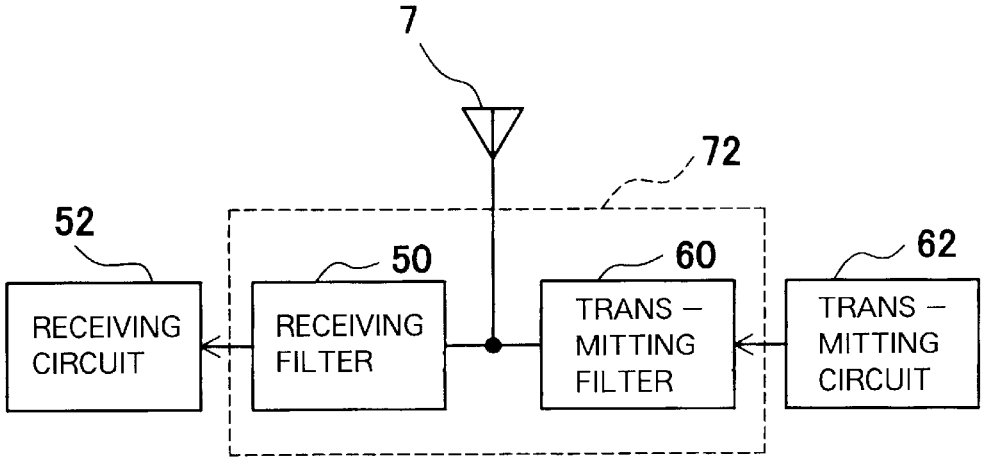
FIG. 35 is a block diagram showing the construction of a mobile communications terminal device.
Figure 36:
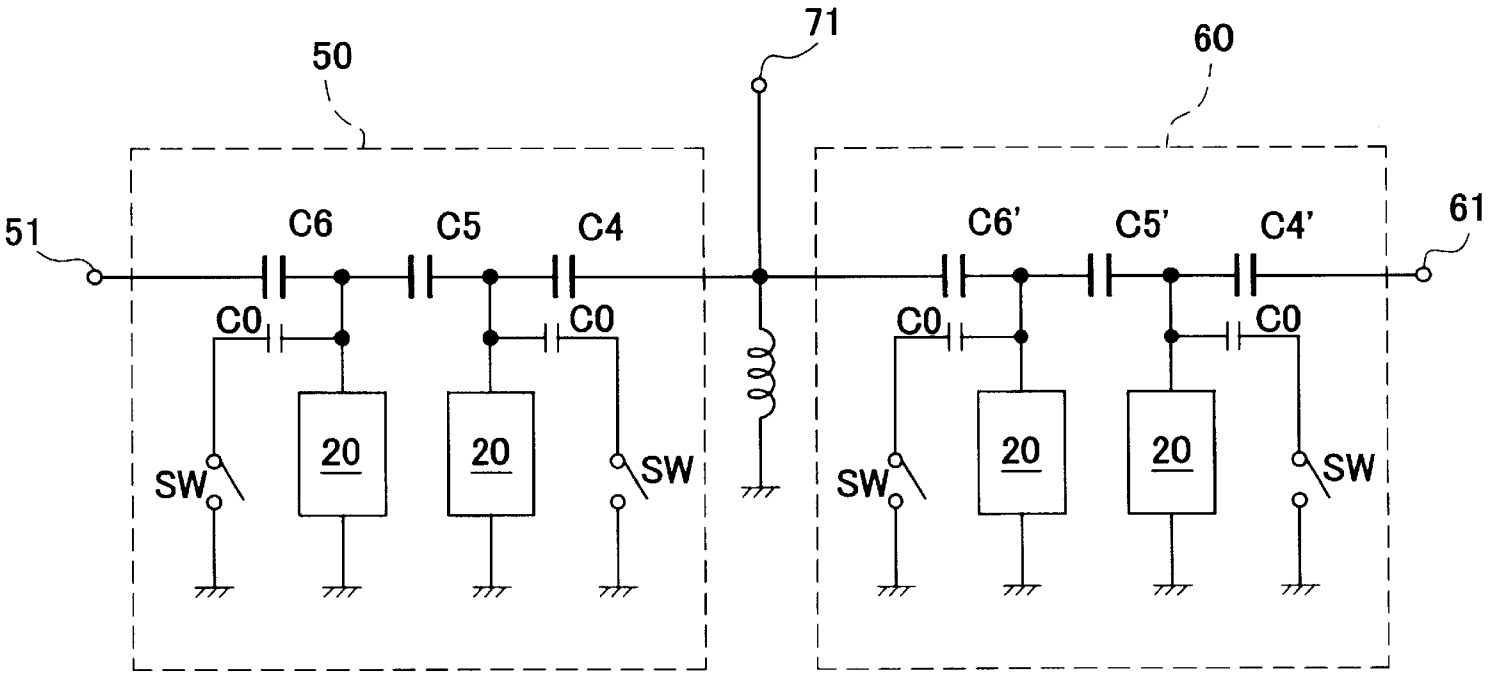
FIG. 36 is a diagram showing an arrangement of conventional receiving filter and transmitting filter.
Figure 37:
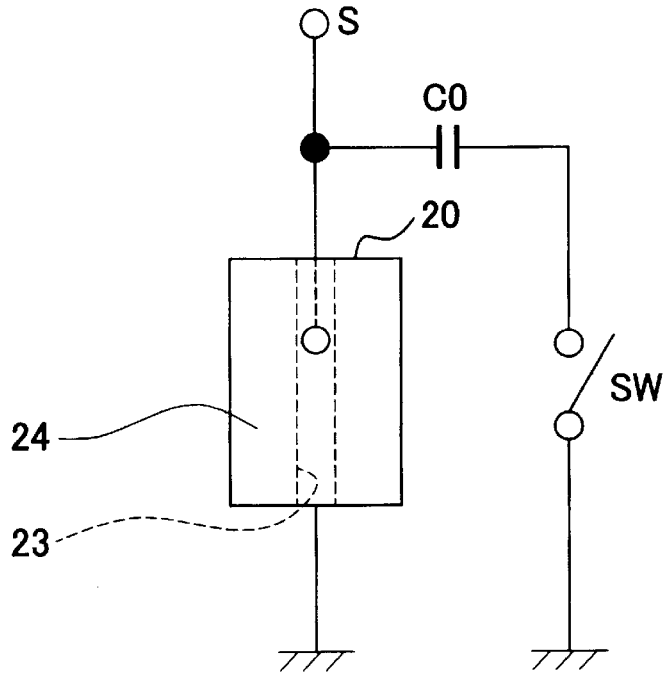
FIG. 37 is a diagram showing the construction of a conventional dielectric resonator device.
Figure 38:
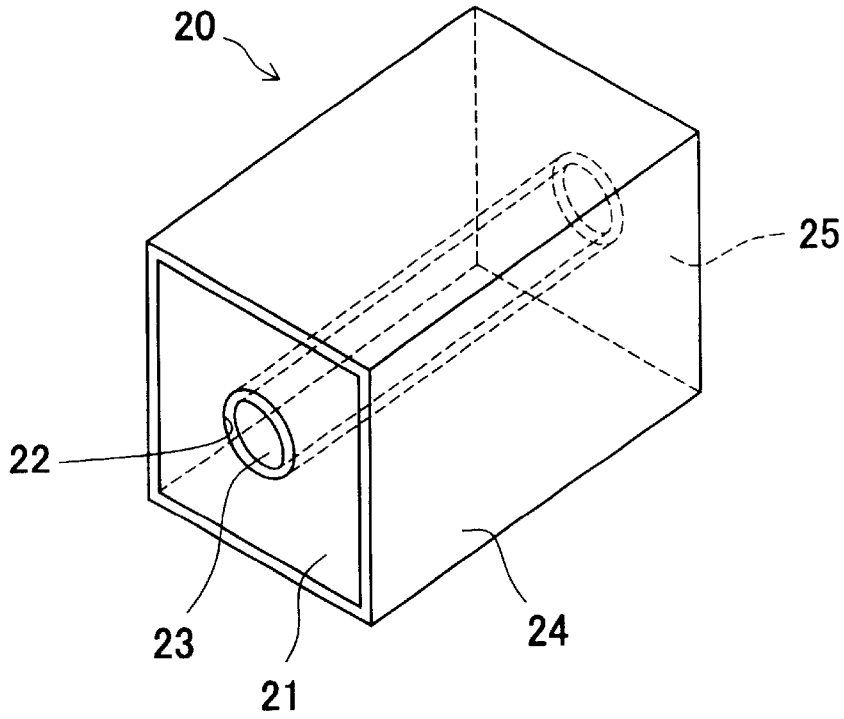
FIG. 38 is a perspective view showing the construction of a conventional coaxial dielectric resonator.
Figure 39:
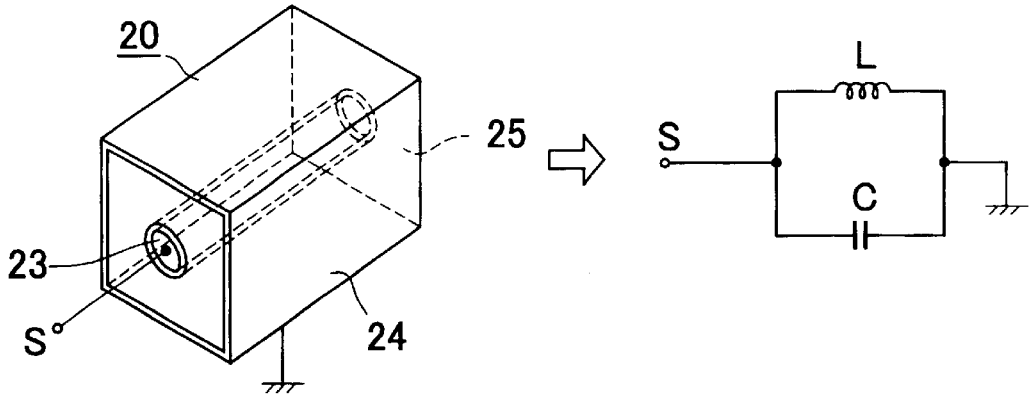
FIG. 39 is a diagram showing an equivalent circuit of the conventional resonator.

The effectiveness of the duplexer 73 of the invention will now be described. With mobile communications systems, the transmitting pass band and the receiving pass band include many channels. FIG. 34 shows the transmitting and receiving bands of CDMA1900 system as such an example. With this system, when a high channel (High Ch) is used for receiving, a high channel is used for transmitting, and when a low channel (Lo Ch) is used for receiving, a low channel is used for transmitting.

When high channels are used for transmitting and receiving, the switches SW of the duplexer 73 are opened, whereby the suppression band of the trap circuit 83 is shifted toward the higher frequency side. As a result, the signal pass characteristics are available with the high-channel band fully suppressed in the transmitting band as shown in FIG. 32. Accordingly there is no likelihood that signals transmitted on the high channel will leak to the receiving circuit.

When low channels are used for transmitting and receiving, on the other hand, the switches SW of the duplexer 73 are closed, whereby the suppression band of the trap circuit 83 is shifted toward the lower frequency side. As a result, the signal pass characteristics are available with the low-channel band fully suppressed in the transmitting band as shown in FIG. 33. Accordingly there is no likelihood that signals transmitted on the low channel will leak to the receiving circuit.

Figure 29:
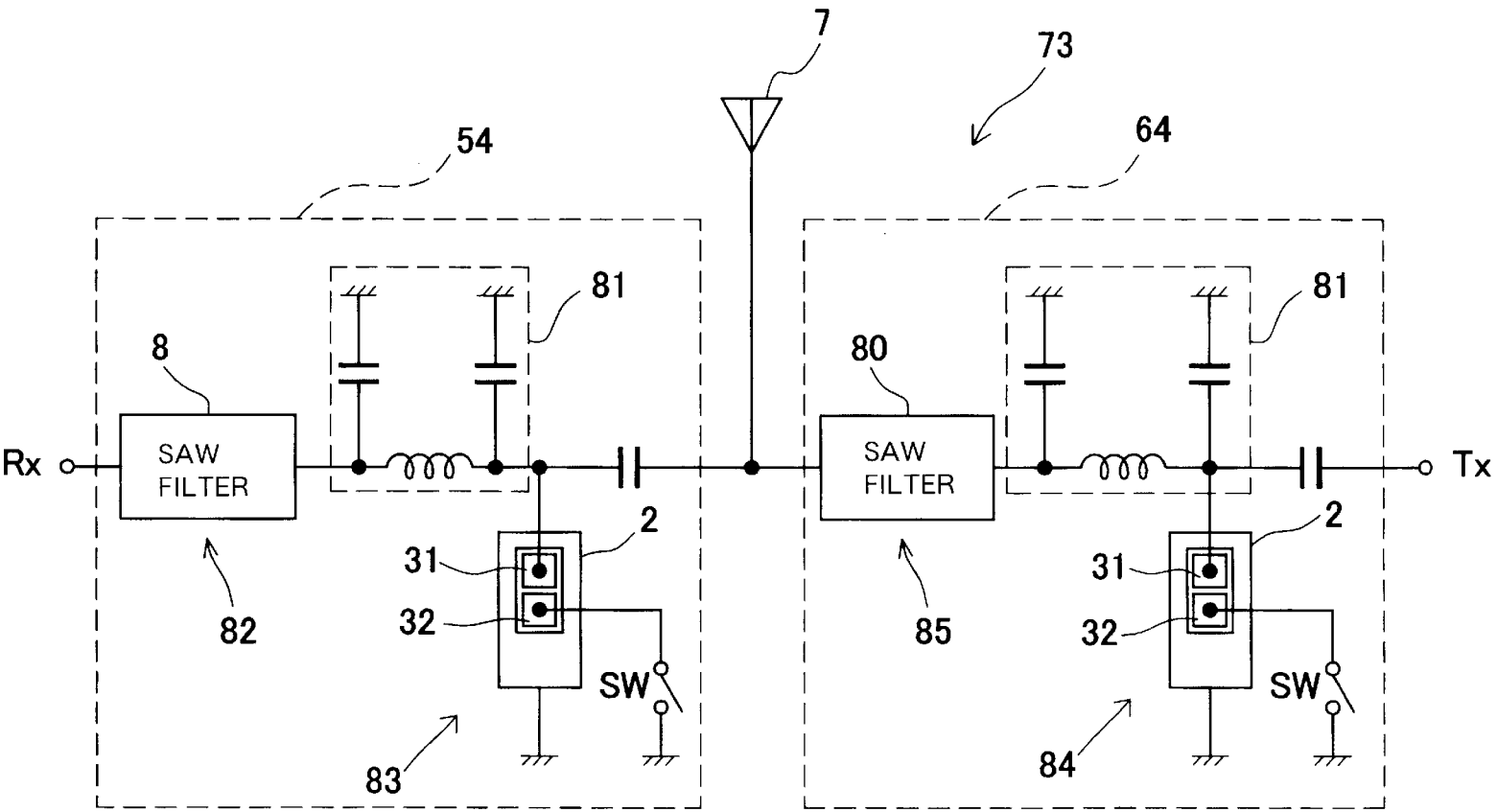
FIG. 29 is a diagram showing the specific construction of another dielectric duplexer.

FIG. 29 shows the construction of another duplexer 73 according to the invention. The receiving filter 54 of this duplexer is the same as the receiving filter 54 of the duplexer 73 of FIG. 28. The transmitting filter 64, on the other hand, comprises a dielectric resonator device serving as a main filter circuit 84 and composed of a coaxial dielectric resonator 2 of the invention and a switch SW, and a SAW filter 80 serving as a trap circuit 85. The same effectiveness as described is also available with this duplexer 73.

Figure 30:
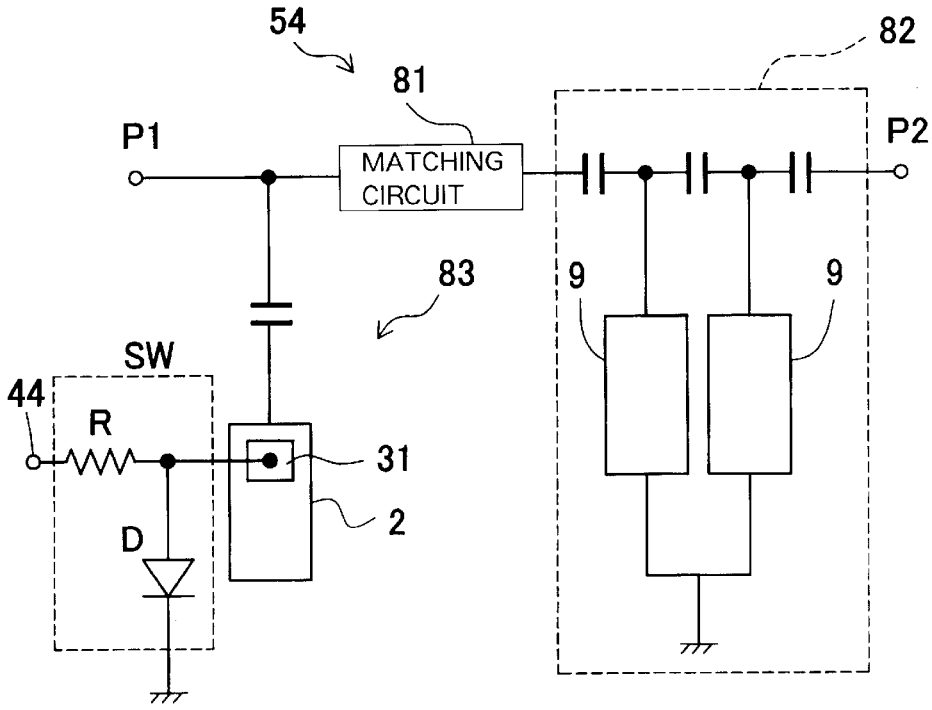
FIG. 30 is a diagram showing the construction of another receiving filter.
Figure 31:
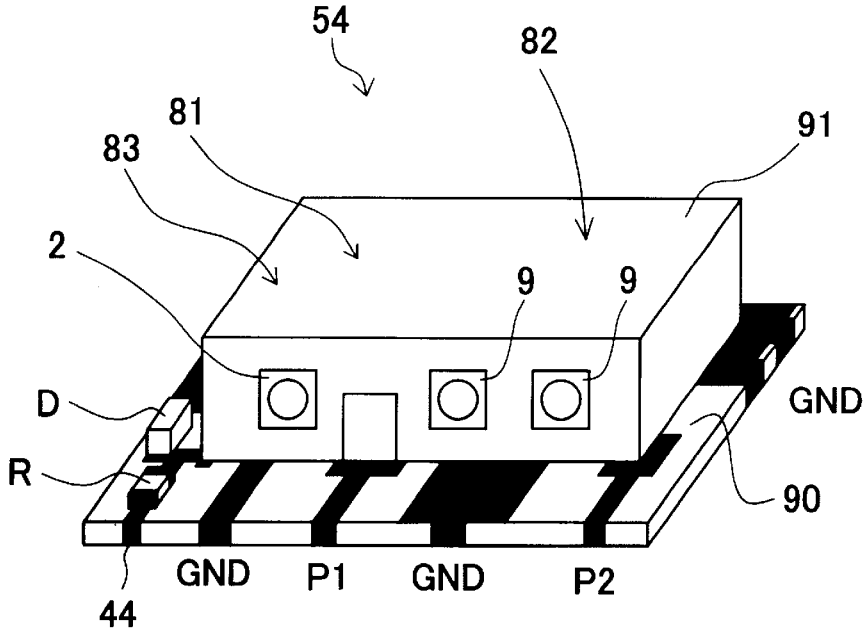
FIG. 31 is a perspective view showing the actual construction of the receiving filter.

FIG. 30 shows the construction of another receiving filter 54, which comprises a trap circuit 83 of the invention composed of a coaxial dielectric resonator 2 and a switch SW, and a main filter circuit 82 provided by a plurality of coaxial dielectric resonators 9. The main filter circuit 82, matching circuit 81 and trap circuit 83 are made into an integral unit using a common dielectric block 91, which is arranged on a circuit board 90 along with a diode D and a resistor R.

The receiving filter 54 is thus provided in the form of a module. This feature reduces the number of assembling steps and achieves a cost reduction in providing mobile communications terminal devices.

What is claimed is:

1. A dielectric resonator device comprising a coaxial dielectric resonator (2), the coaxial dielectric resonator (2) comprising:

a dielectric block (21) having a bore (22) extending therethrough, an outer conductor layer (24) formed on an outer peripheral surface of the dielectric block (21), an inner conductor layer (23) formed on the dielectric block (21) over an inner peripheral surface thereof defining the bore (22), a short-circuiting conductor layer (25) formed on the dielectric block (21) over an end face thereof where the bore (22) has an opening and providing a short circuit between the outer conductor layer (24) and the inner conductor layer (23), and a separated conductor layer (3) formed on the outer peripheral surface of the dielectric block (21) and electrically separated from the outer conductor layer (24), the separated conductor layer (3) of the resonator (2) having connected thereto a switch SW by which the capacitance C' provided between the separated conductor layer (3) and the inner conductor layer (23) is connected to or disconnected from the capacitance C provided between the outer conductor layer (24) and the inner conductor layer (23) upon switching to thereby vary the resonance frequency of the resonator (2).

2. A dielectric resonator device according to claim 1 wherein the separated conductor layer (3) of the resonator (2) is connected to the ground via the switch SW, and the separated conductor layer (3) is connected to or disconnected from the ground by operating the switch SW.

3. A dielectric resonator device according to claim 1 wherein the separated conductor layer (3) of the resonator (2) is provided by forming a groove (26) in the outer conductor layer (24) covering the outer peripheral surface of the dielectric block (21) and separating off a portion of the outer conductor layer (24).

4. A dielectric resonator device according to claim 1 wherein the inner conductor layer (23) of the resonator (2) is connected to a signal input terminal S, and the outer conductor layer (24) is connected to the ground.

5. A dielectric resonator device according to claim 1 wherein the separated conductor layer (3) comprises a first separated conductor layer (31) and a second separated conductor layer (32) which are electrically separated from each other, the first separated conductor layer (31) being connected to an input signal terminal S, the second separated conductor layer (32) being connected to the ground via the switch SW, the outer conductor layer (24) being connected to the ground.

6. A dielectric filter comprising a first dielectric resonator device (11) and a second dielectric resonator device (12) which are connected to, and located respectively at two positions on, a signal line extending from an input terminal (42) to an output terminal (43), at least one of the dielectric resonator devices comprising a coaxial dielectric resonator (2), the coaxial dielectric resonator (2) comprising:

a dielectric block (21) having a bore (22) extending therethrough, an outer conductor layer (24) formed on an outer peripheral surface of the dielectric block (21), an inner conductor layer (23) formed on the dielectric block (21) over an inner peripheral surface thereof defining the bore (22), a short-circuiting conductor layer (25) formed on the dielectric block (21) over an end face thereof where the bore (22) has an opening and providing a short circuit between the outer conductor layer (24) and the inner conductor layer (23), and a separated conductor layer (3) formed on the outer peripheral surface of the dielectric block (21) and electrically separated from the outer conductor layer (24), the separated conductor layer (3) of the resonator (2) having connected thereto a switch SW by which the capacitance C' provided between the separated conductor layer (3) and the inner conductor layer (23) is connected to or disconnected from the capacitance C provided between the outer conductor layer (24) and the inner conductor layer (23) upon switching to thereby give altered signal passage characteristics.

7. A dielectric filter according to claim 6 wherein a first inductance element L1, a second inductance element L2 and a third inductance element L3 are provided on the signal line extending from the input terminal 42 to the output terminal 43, the first dielectric resonator device 11 being connected via a first capacitance element C1 to a point of connection between the first inductance element L1 and the second inductance element L2, the second dielectric resonator device 12 being connected via a second capacitance element C2 to a point of connection between the second inductance element L2 and the third inductance element L3.

8. A dielectric filter according to claim 6 wherein the separated conductor layer (3) of the coaxial dielectric resonator (2) comprises a first separated conductor layer (31) and a second separated conductor layer (32) which are electrically separated from each other, the first separated conductor layer (31) being connected to an input signal terminal S, the second separated conductor layer (32) being connected to the ground via the switch SW, the outer conductor layer (24) being connected to the ground.

9. A dielectric filter according to claim 8 wherein a first inductance element L1, a second inductance element L2 and a third inductance element L3 are provided on the signal line extending from the input terminal 42 to the output terminal 43, a first dielectric resonator device 13 being connected directly to a point of connection between the first inductance element L1 and the second inductance element L2, a second dielectric resonator device 14 being connected directly to a point of connection between the second inductance element L2 and the third inductance element L3.

10. A dielectric filter according to claim 6 wherein a first capacitance element C4, a second capacitance element C5 and a third capacitance element C6 are provided on the signal line extending from the input terminal 42 to the output terminal 43, the first dielectric resonator device 11 being connected to a point of connection between the first capacitance element C4 and the second capacitance element C5, the second dielectric resonator device 12 being connected to a point of connection between the second capacitance element C5 and the third capacitance element C6.

11. A dielectric filter comprising a main filter circuit (82) having a pass band in the frequency band of a high frequency signal to be received or transmitted and a trap circuit (83) connected in series with the main filter circuit (82) for attenuating a signal component having a frequency band as shifted from the pass band, the trap circuit (83) comprising a coaxial dielectric resonator (2), the coaxial dielectric resonator (2) comprising:

a dielectric block (21) having a bore (22) extending therethrough, an outer conductor layer (24) formed on an outer peripheral surface of the dielectric block (21), an inner conductor layer (23) formed on the dielectric block (21) over an inner peripheral surface thereof defining the bore (22), a short-circuiting conductor layer (25) formed on the dielectric block (21) over an end face thereof where the bore (22) has an opening and providing a short circuit between the outer conductor layer (24) and the inner conductor layer (23), and a separated conductor layer (3) formed on the outer peripheral surface of the dielectric block (21) and electrically separated from the outer conductor layer (24), the separated conductor layer (3) of the resonator (2) having connected thereto a switch SW by which the capacitance C' provided between the separated conductor layer (3) and the inner conductor layer (23) is connected to or disconnected from the capacitance C provided between the outer conductor layer (24) and the inner conductor layer (23) upon switching to thereby vary the signal attenuation characteristics of the trap circuit (83).

12. A dielectric duplexer comprising a receiving filter (5) and a transmitting filter (6) which are connected in parallel with an antenna terminal (71) for connecting an antenna (7) thereto, each of the receiving filter (5) and the transmitting filter (6) comprising one or a plurality of coaxial dielectric resonators (2), each of the coaxial dielectric resonators (2) comprising:

a dielectric block (21) having a bore (22) extending therethrough, an outer conductor layer (24) formed on an outer peripheral surface of the dielectric block (21), an inner conductor layer (23) formed on the dielectric block (21) over an inner peripheral surface thereof defining the bore (22), a short-circuiting conductor layer (25) formed on the dielectric block (21) over an end face thereof where the bore (22) has an opening and providing a short circuit between the outer conductor layer (24) and the inner conductor layer (23), and a separated conductor layer (3) formed on the outer peripheral surface of the dielectric block (21) and electrically separated from the outer conductor layer (24), the separated conductor layer (3) of the resonator (2) having connected thereto a switch SW by which the capacitance C' provided between the separated conductor layer (3) and the inner conductor layer (23) is connected to or disconnected from the capacitance C provided between the outer conductor layer (24) and the inner conductor layer (23) upon switching to thereby alter the signal passage characteristics of the receiving filter (5) or the transmitting filter (6).

13. A dielectric duplexer comprising a receiving filter (54) and a transmitting filter (64) which are connected in parallel with an antenna terminal (71) for connecting an antenna (7) thereto, the receiving filter (54) comprising a main filter circuit (82) having a pass band in the frequency band of the signal to be received and a trap circuit (83) connected in series with the main filter circuit (82) for attenuating the frequency band of the signal to be transmitted, the trap circuit (83) comprising a coaxial dielectric resonator (2), the coaxial dielectric resonator (2) comprising:

a dielectric block (21) having a bore (22) extending therethrough, an outer conductor layer (24) formed on an outer peripheral surface of the dielectric block (21), an inner conductor layer (23) formed on the dielectric block (21) over an inner peripheral surface thereof defining the bore (22), a short-circuiting conductor layer (25) formed on the dielectric block (21) over an end face thereof where the bore (22) has an opening and providing a short circuit between the outer conductor layer (24) and the inner conductor layer (23), and a separated conductor layer (3) formed on the outer peripheral surface of the dielectric block (21) and electrically separated from the outer conductor layer (24), the separated conductor layer (3) of the resonator (2) having connected thereto a switch SW by which the capacitance C' provided between the separated conductor layer (3) and the inner conductor layer (23) is connected to or disconnected from the capacitance C provided between the outer conductor layer (24) and the inner conductor layer (23) upon switching to thereby vary the signal pass characteristics of the receiving filter (54).

14. A dielectric duplexer according to claim 13 wherein the transmitting filter (64) comprises a main filter circuit (84) having a pass band in the frequency band of the signal to be transmitted and an attenuation band in the frequency band of the signal to be received, the main filter circuit (84) comprising a coaxial dielectric resonator (2), the coaxial dielectric resonator (2) comprising:

a dielectric block (21) having a bore (22) extending therethrough, an outer conductor layer (24) formed on an outer peripheral surface of the dielectric block (21), an inner conductor layer (23) formed on the dielectric block (21) over an inner peripheral surface thereof defining the bore (22), a short-circuiting conductor layer (25) formed on the dielectric block (21) over an end face thereof where the bore (22) has an opening and providing a short circuit between the outer conductor layer (24) and the inner conductor layer (23), and a separated conductor layer (3) formed on the outer peripheral surface of the dielectric block (21) and electrically separated from the outer conductor layer (24), the separated conductor layer (3) of the resonator (2) having connected thereto a switch SW by which the capacitance C' provided between the separated conductor layer (3) and the inner conductor layer (23) is connected to or disconnected from the capacitance C provided between the outer conductor layer (24) and the inner conductor layer (23) upon switching to thereby vary the signal pass characteristics of the transmitting filter (64).

15. A dielectric duplexer according to claim 13 wherein the main filter circuit (82) of the receiving filter (54) comprises one or a plurality of coaxial dielectric resonators (9), and the coaxial dielectric resonators (9) constituting the main filter circuit (82) and the coaxial dielectric resonator (2) constituting the trap circuit (83) are made into an integral unit by a common dielectric block (91).

* * * * *